US009869966B2

(12) United States Patent
Yuan et al.

(10) Patent No.: US 9,869,966 B2
(45) Date of Patent: Jan. 16, 2018

(54) IMAGE FORMING APPARATUS AND REMOVABLE UNIT

(71) Applicant: FUJI XEROX CO., LTD., Tokyo (JP)

(72) Inventors: Lei Yuan, Kanagawa (JP); Toshio Takiguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/085,213

(22) Filed: Mar. 30, 2016

(65) Prior Publication Data

US 2017/0102667 A1 Apr. 13, 2017

(30) Foreign Application Priority Data

Oct. 9, 2015 (JP) ..... 2015-201074

(51) Int. Cl.
*G03G 21/16* (2006.01)
*G03G 21/18* (2006.01)

(52) U.S. Cl.
CPC ..... *G03G 21/1652* (2013.01); *G03G 21/1647* (2013.01); *G03G 21/1867* (2013.01)

(58) Field of Classification Search
CPC ..... G03G 21/1647; G03G 21/1652
See application file for complete search history.

(56) References Cited

U.S. PATENT DOCUMENTS

2004/0028424 A1* 2/2004 Yokoi ..... G03G 15/0121 399/90

FOREIGN PATENT DOCUMENTS

| | | |
|---|---|---|
| JP | 2008-224782 A | 9/2008 |
| JP | 2013-154730 A | 8/2013 |
| JP | 2015-025910 A | 2/2015 |

* cited by examiner

*Primary Examiner* — David M Gray
*Assistant Examiner* — Andrew V Do
(74) *Attorney, Agent, or Firm* — Oliff PLC

(57) ABSTRACT

An image forming apparatus includes an apparatus body including a mounting section provided with a first connection terminal, and a removable unit provided with a second connection terminal. The second connection terminal is held by a holding member that is mounted on a side surface portion of the removable unit while the holding member is displaceable in a direction that is orthogonal to a movement direction of the removable unit when the removable unit is mounted or removed and while the holding member is pushed towards an outer side of the side surface portion by an elastic member. When the removable unit is mounted, the holding member becomes displaced towards an inner side of the side surface portion, and the holding member becomes pushed towards the outer side of the side surface portion by the elastic member, so that the second connection terminal contacts the first connection terminal.

6 Claims, 16 Drawing Sheets

IMAGE FORMING APPARATUS AND REMOVABLE UNIT

CROSS-REFERENCE TO RELATED APPLICATIONS

This application is based on and claims priority under 35 USC 119 from Japanese Patent Application No. 2015-201074 filed Oct. 9, 2015.

BACKGROUND

Technical Field

The present invention relates to an image forming apparatus and a removable unit.

SUMMARY

According to an aspect of the invention, there is provided an image forming apparatus including an apparatus body that includes a mounting section that is provided with a first connection terminal that performs electrical connection, and a removable unit that is removably mounted on the mounting section of the apparatus body, the removable unit being provided with a second connection terminal that is disposed at a side surface portion of the removable unit and that contacts and is connected with the first connection terminal when the removable unit is mounted, the side surface portion being a side surface with respect to a movement direction of the removable unit when the removable unit is mounted or removed. The second connection terminal is held by a holding member that is mounted on the side surface portion of the removable unit while the holding member is displaceable in a direction that is orthogonal to the movement direction of the removable unit when the removable unit is mounted or removed and while the holding member is pushed towards an outer side of the side surface portion by an elastic member. When the removable unit is mounted, the holding member becomes displaced towards an inner side of the side surface portion, and becomes pushed towards the outer side of the side surface portion by the elastic member that is elastically deformed in accordance with the displacement towards the inner side, so that the second connection terminal contacts the first connection terminal.

BRIEF DESCRIPTION OF THE DRAWINGS

Exemplary embodiments of the present invention will be described in detail based on the following figures, wherein.

DETAILED DESCRIPTION

Exemplary embodiments of the present invention are hereunder described with reference to the drawings.

Exemplary Embodiment

Figure 1:
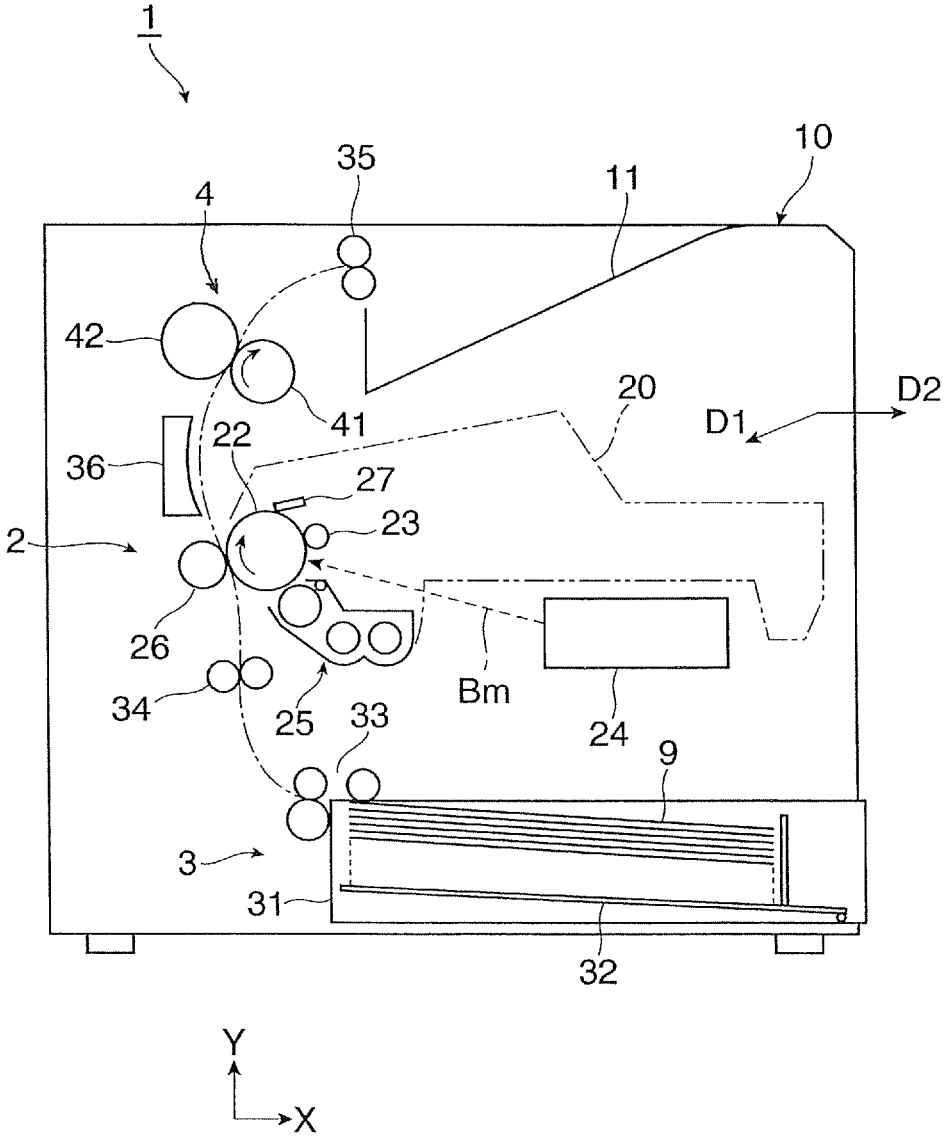
FIG. 1 is an explanatory view of a structure of an image forming apparatus according to an exemplary embodiment.
Figure 2:
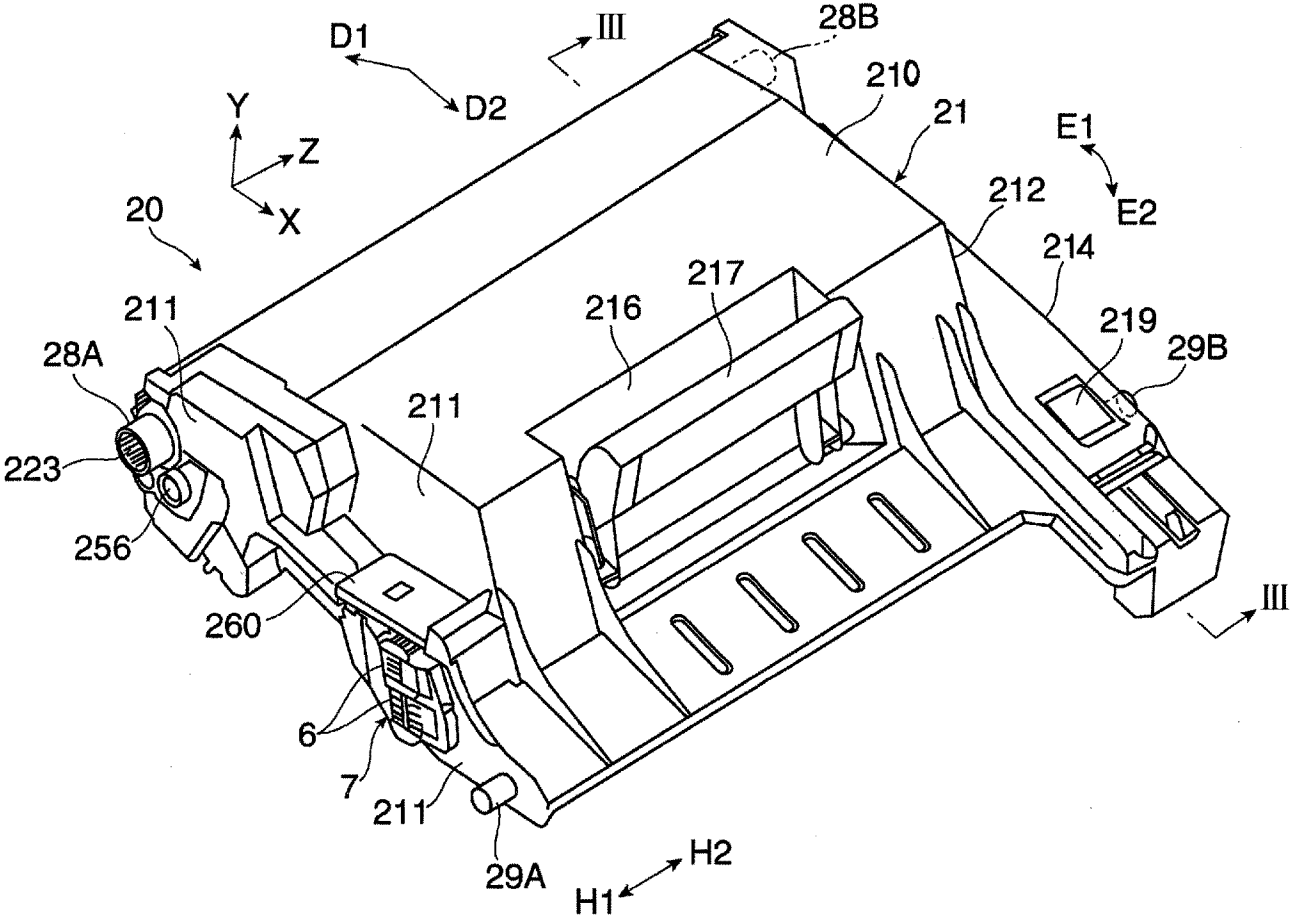
FIG. 2 is a perspective view of a removable unit that is used in the image forming apparatus shown in FIG. 1.
Figure 3:
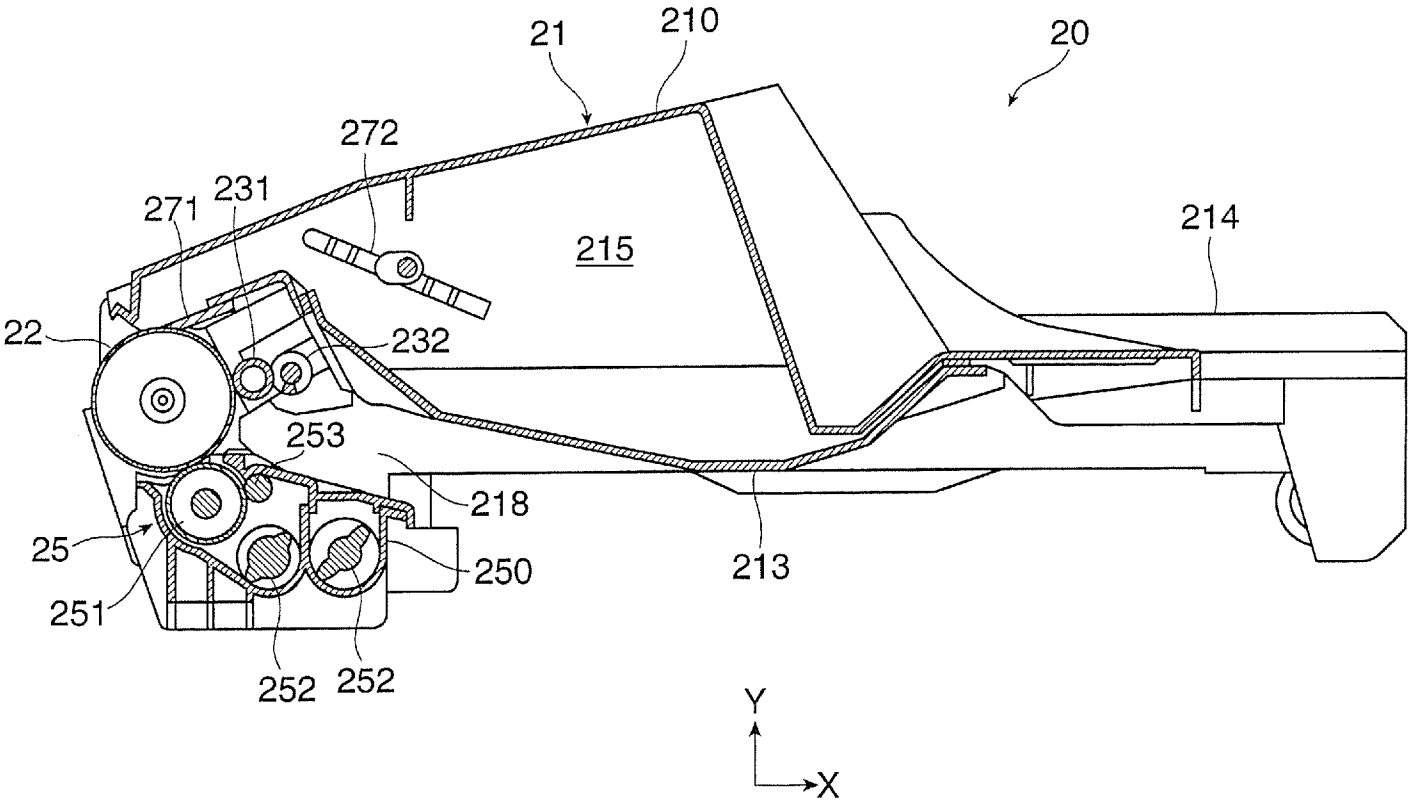
FIG. 3 is a schematic sectional view taken along line of the removable unit shown in FIG. 2.

FIGS. 1 to 3 illustrate, for example, an image forming apparatus 1 according to an exemplary embodiment. FIG. 1 is a schematic view of the interior of the image forming apparatus 1. FIG. 2 illustrates a removable unit 20 that is removably mounted on the image forming apparatus 1. FIG. 3 is a partial sectional view of a structure of the removable unit 20 shown in FIG. 2. Arrows X, Y, and Z in the figures below denote (the directions of) orthogonal coordinate axes indicating, respectively, a width direction, a height direction, and a depth direction in three-dimensional space assumed in the figures.

Overall Structure of Image Forming Apparatus

As shown in FIG. 1, the image forming apparatus 1 includes, for example, an image forming device 2, a sheet-feeding device 3, and a fixing device 4 in the interior of a housing 10, serving as an apparatus body. The image forming device 2 forms an image from toner, serving as developer, and finally transfers the toner image to a recording sheet 9, serving as an exemplary recording medium. The sheet-feeding device 3 contains required recording sheets 9 and transports and supplies the recording sheets 9 to a transfer position of the image forming device 2. The fixing device 4 fixes the transferred toner image to the recording sheet 9. Reference numeral 11 in, for example, FIG. 1 denotes a holding section that is provided at an upper surface portion of the housing 10. The recording sheet 9 on which the image forming operation has been completed is discharged onto and held by the holding section 11. The housing 10 includes various members, such as a structural member and an external member.

The image forming device 2 principally includes a photoconductor drum 22, a charging device 23, an exposure device 24, a developing device 25, a transfer device 26, and a cleaning device 27. The photoconductor drum 22, which is a photosensitive member having the form of a drum, is rotationally driven in the arrowed direction (clockwise in FIG. 1). The charging device 23 charges the surface of the photoconductor drum 22 (that is an outer peripheral surface portion, which is an image formation region, of the photoconductor drum 22). The exposure device 24 irradiates the charged surface of the photoconductor drum 22 with light (Bm) based on image information (signal), and forms an electrostatic latent image. The developing device 25 develops the electrostatic latent image on the photoconductor drum 22 by using toner (serving as developer) to form a toner image. The transfer device 26 transfers the toner image on the photoconductor drum 22 to a recording sheet 9. The cleaning device 27 removes and cleans off any undesired substances, such as toner, remaining on the surface of the photoconductor drum 22 after the transfer.

The photoconductor drum 22 includes, for example, a photodielectric layer formed on a cylindrical conductive base member that is grounded. The photodielectric layer is formed from an organic photosensitive material. As shown in, for example, FIG. 3, a contact charging device is used as the charging device 23. Such a contact charging device charges the surface of the photoconductor drum 22 as a result of supplying charging voltage or the like to a charging roller 231 that is driven and rotated while contacting the surface of the photoconductor drum 22. Reference numeral 232 in FIG. 3 denotes a rotary cleaning brush that cleans the surface of the charging roller 231 by rotating while contacting the surface of the charging roller 231. The exposure device 24 performs exposure on the basis of an image signal acquired after an image processing device (not shown) has performed a required processing operation on the image information that is input from image information providing sources, such as a storage medium reading device, an external connection device, and an original reading device, that are connected with or provided in the image forming apparatus 1. As the exposure device 24, for example, the following devices are used: a device including multiple light emitting diodes that are disposed in a row along the direction of a rotary shaft of the photoconductor drum 22, and a scanning-type device that performs exposure such that scanning by using light from a semiconductor laser is performed along an axial direction of the photoconductor drum 22 through multiple types of optical components, such as a rotary polygon mirror.

As shown in, for example, FIG. 3, the developing device 25 includes a housing 250 that contains required developer. The developing device 25 also includes a developing roller 251, stirring transporting members 252, and a layer-thickness restricting member 253. The developing roller 251 holds the developer in the housing 250 and is rotationally driven so as to transport the held developer to a development region that faces and is spaced apart from the photoconductor drum 22 by a required interval. The stirring transporting members 252 transport the developer in the housing 250 so as to supply the developer to the developing roller 251 while stirring the developer in the housing 250. The layer-thickness restricting member 253 restricts the amount of developer (layer thickness) that is held by the developing roller 251. As the transfer device 26, a contact transfer device is used. The contact transfer device performs the transfer as a result of supplying transfer voltage to a transfer roller that is driven and rotated while contacting the surface of the photoconductor drum 22. As shown in, for example, FIG. 3, as the cleaning device 27, a contact cleaning device in which, for example, a plate-like cleaning member 271 is brought into contact with a peripheral surface of the photoconductor drum 22 is used.

The sheet-feeding device 3 includes a sheet container 31 and a sending-out device 33. The sheet container 31 contains the multiple recording sheets 9 that are stacked on a stacking plate 32. The multiple recording sheets 9 are of, for example, required sizes and types that are used in forming images. The sending-out device 33 sends out the recording sheets 9 contained in the sheet container 31 one sheet at a time. The sheet container 31 is mounted on the housing 10 so as to be capable of being drawn out from the housing 10. In accordance with the mode of use, multiple sheet containers 31 are provided. The alternate long and short dash line in, for example, FIG. 1 denotes a principal sheet transport path of the recording sheets 9 in the housing 10. The transport path is formed by, for example, a pair of sheet transport rollers 34, a pair of sheet transport rollers 35, and multiple transport guides 36.

The fixing device 4 includes, for example, a heating rotary member 41 and a pressing rotary member 42 in the housing having an inlet and an outlet (not shown). The heating rotary member 41 has the form of, for example, a roller or a belt that is rotationally driven in the arrowed direction and whose surface temperature is increased to and maintained at a required temperature by a heating unit. The pressing rotary member 42 has the form of, for example, a roller or a belt-pad that is driven and rotated while contacting with required pressure the heating rotary member 41 substantially along an axial direction of the heating rotary member 41. In the fixing device 4, a contact portion where the heating rotary member 41 and the pressing rotary member 42 contact each other is formed as a fixing section that performs a required fixing operation (heating and pressing operation) when a recording medium 9 to which an unfixed toner image has been transferred passes through the fixing section.

As shown in, for example, FIGS. 1 to 3, in the image forming apparatus 1, the photoconductor 22, the charging device 23, the developing device 25, and the cleaning device 27, which are some of the components of the image forming device 2, are integrated with each other by being supported by a common supporting frame. The integrated structure as a whole forms a removable unit 20 that is removably mounted on a mounting section 12 (described below) that is part of the housing 10. The removable unit 20 according to the exemplary embodiment corresponds to a so-called "process cartridge". The removable unit 20 is described in detail below.

The image forming apparatus 1 forms an image as follows. Here, a basic image forming process that is performed when an image is to be formed on one side of a recording sheet 9 is described as an example.

When the image forming apparatus 1 receives an image forming process start instruction, in the image forming device 2, the surface of the photoconductor drum 22 that starts to rotate is charged to a predetermined polarity and potential by the charging device 23, after which the exposure device 24 exposes the charged surface of the photoconductor drum 22 to light on the basis of the image information, so that an electrostatic latent image having a required potential is formed. Next, when the electrostatic latent images passes through the developing device 25, the electrostatic latent image formed on the photoconductor drum 22 is developed by using toner supplied by the developing roller 251 and charged to a required polarity, so that the electrostatic latent image is made visible as a toner image.

Thereafter, when the toner image that is formed on the photoconductor 22 is transported to the transfer position facing the transfer device 26 by the rotation of the photoconductor drum 22, in accordance with the timing of such transport of the toner image, the transfer device 26 transfers such toner image to one side of the recording medium 9 that is supplied along the sheet transport path from the sheet-feeding device 3. The cleaning device 27 cleans the surface of the photoconductor drum 22 after the transfer.

Next, the recording sheet 9 to which the toner image has been transferred is transported so as to enter the fixing device after the recording sheet 9 has been separated from the photoconductor drum 22. Then, when the unfixed toner image is subjected to a fixing operation when the unfixed toner image passes through the fixing section disposed between the heating rotary member 41 and the pressing rotary member 42 of the fixing device 4, the unfixed toner image is melted under pressure and is fixed to the recording sheet 9. The recording sheet 9 after the fixing has been completed is discharged from the fixing device 4 and is transported along the sheet transport path. Finally, the recording sheet 9 is discharged onto the upper surface portion of the housing 10, and is held by the holding section 11.

By performing the above-described operations, a monochromatic image formed by using toner of one color is formed on one side of one recording sheet 9, and the basic image forming process ends. When an instruction for executing the image forming process on multiple sheets is issued, the above-described operations are similarly repeated in accordance with the number of sheets.

Structure of Removable Unit

As shown in, for example, FIGS. 2 and 3, the removable unit 20 is formed so as to be mounted or removed by being moved substantially along the direction of arrow D1 or the direction of arrow D2 when the removable unit 20 is mounted or removed. The removable unit 20 is formed so as to be covered by an external member (housing) 21 having a substantially box shape in its entirety and also serving as a supporting member.

The removable unit 20 according to the exemplary embodiment includes, as the external member 21, a member having an upper surface portion 210, side surface portions 211 and 212, a bottom surface portion 213, and an extending portion 214. The upper surface portion 210 is positioned at the upper side when the removable unit 20 is used. The side surface portions 211 and 212 are respective left and right side surfaces with respect to the direction of movement of the removable unit 20 when the removable unit 20 is mounted or removed. The bottom surface portion 213 is positioned at the lower side when the removable unit 20 is used. The extending portion 214 extends in a protruding state in a direction opposite to the insertion direction D1 (that is, the removing direction D2) from a lower portion of the right side surface portion 212.

In, for example, FIGS. 2 and 3, reference numeral 215 denotes a collecting space for containing discarded developer removed by the cleaning device 27; reference numeral 216 denotes an accommodating section having a recess for accommodating a handle that is used when the removal unit 20 is held and handled by a user with his/her hand; reference numeral 217 denotes a handle that rotates in the direction of arrow E1 and in the direction of arrow E2 in the accommodating section 216; and reference numeral 218 denotes an exposure space for allowing the light (Bm) that is generated from the exposure device 24 to reach the surface of the photoconductor drum 22. A leveling member 272 that levels the discarded developer contained in the collecting space 215 is disposed in the collecting space 215. Incidentally, the extending portion 214 of the external member 21 is formed as a developer transport path for transporting replenishing developer that is sent out from a developer container (such as a toner cartridge) (not shown) that contains the replenishing developer towards the developing device 25. Reference numeral 219 in FIG. 2 denotes an intake for taking in the replenishing developer.

In the removable unit 20, a first protrusion 28A and a second protrusion 29A are provided on the side surface portion 211 of the external member 21, and a first protrusion 28B and a second protrusion 29B are provided on the side surface portion 212 of the external member 21. The first protrusions 28A and 28B and the second protrusions 29A and 29B are provided for guiding the removable unit 20 in the movement directions D1 and D2 of the removable unit 20 when the removable unit 20 is mounted and removed, and for positioning the removable unit 20 when the removable unit 20 is mounted.

The first protrusions 28A and 28B are provided as cylindrical structural portions at portions of the respective side surface portions 211 and 212 that become leading sides when the removable unit 20 is moved at the time of mounting the removable unit 20. The structural portions protrude in directions that are substantially orthogonal to the movement directions D1 and D2 of the movable unit 20 when the removable unit 20 is mounted and removed (for example, directions that are substantially parallel to the direction of arrow Z of the coordinate axis). The first protrusion 28A that is provided at the side surface portion 211 is disposed such that an input-side connecting member 223 for inputting rotational power secured to one rotary shaft of the photoconductor drum 22 is rotatably disposed in an internal space of the first protrusion 28A. Reference numeral 256 in FIG. 2 denotes an input-side connecting member for inputting rotational power secured to one rotary shaft of the developing roller 251 of the developing device 25. The input-side connecting member 256 is disposed near the first protrusion 28A at an obliquely lower side of the first protrusion 28A.

On the other hand, the second protrusions 29A and 29B are provided as cylindrical or columnar structural portions at portions of the respective side surface portions 211 and 212 that become trailing sides when the removable unit 20 is moved at the time of mounting the removable unit 20. The structural portions protrude in the directions that are substantially orthogonal to the movement directions D1 and D2 of the removable unit 20 when the removable unit 20 is mounted and removed.

Further, as shown in, for example, FIG. 2, the removable unit 20 is provided with second connection terminals 6*a* to 6*g* on, for example, the side surface portion 211 (left side surface portion). The second connection terminals 6*a* to 6*g* of the removable unit 20 are provided for being electrically connected with first connection terminals 5*a* to 5*g* that are provided on the mounting section 12 (described below).

The second connection terminals 6*a* to 6*g* are thin plates made of a conductive material, such as a metal, and having a required planar shape, such as a rectangular shape. As shown in, for example, FIGS. 2 and 3, the second connection terminals 6*a* to 6*g* are held by a holding member 7, and are mounted on a mounting portion 260 that is mounted on the side surface portion 211 of the removable unit 20 through the holding member 7. Three of the second connection terminals 6, that is, the second connection terminals 6*a* to 6*c* are used as, for example, electronic-information input-output terminals of an electronic component 61 (FIG. 7), such as a storage element, that is mounted on the holding member 7. The remaining four second connection terminals, that is, the second connection terminals 6*d* to 6*g* are used as, for example, electronic-information input-output terminals of a different electronic component 62 (see FIG. 7), such as a storage element, that is mounted on the holding member 7.

Figure 5:
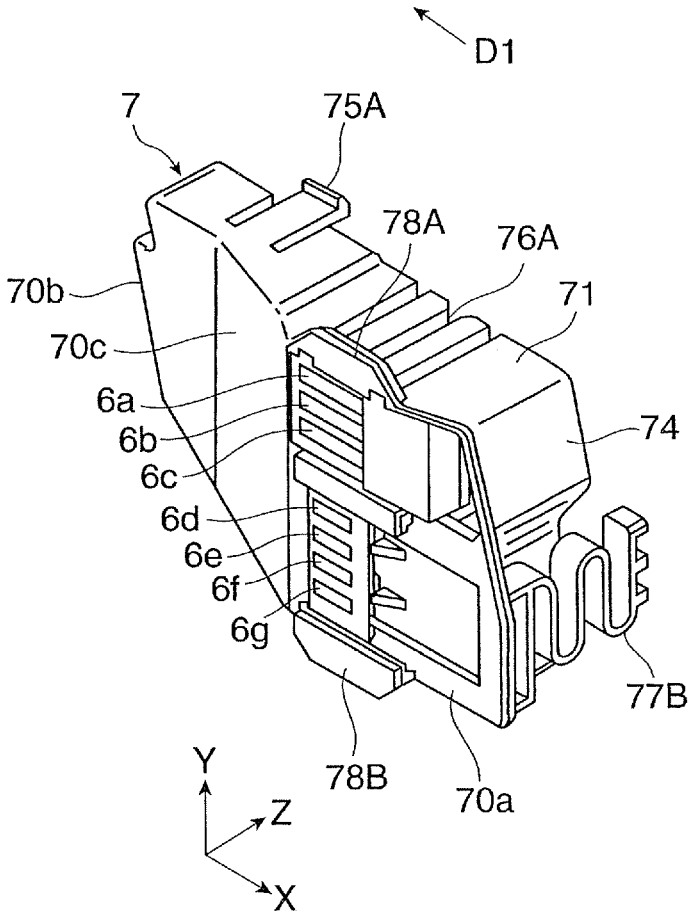
FIG. 5 is a perspective view of the second connection terminals and the holding member shown in FIG. 4.
Figure 6D:
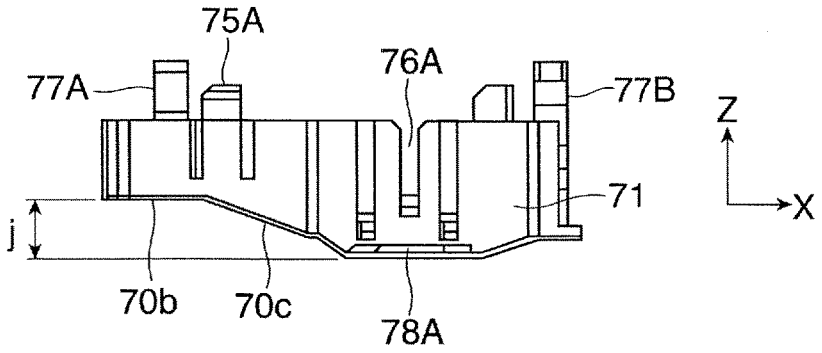
FIGS. 6A to 6E principally illustrate the holding member shown in FIG. 4, with FIG. 6A being a front view of the holding member, FIG. 6B being a right side view of the holding member, FIG. 6C being a left side view of the holding member, FIG. 6D being a plan view of the holding member, and FIG. 6E being a bottom view of the holding member.
Figure 6B:
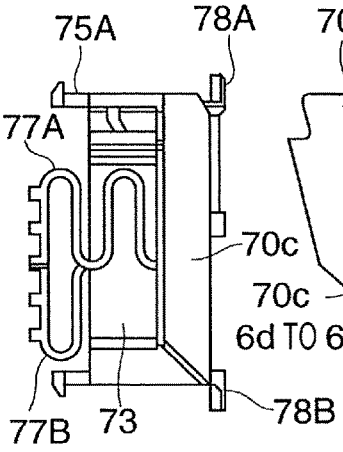
Figure 6A:
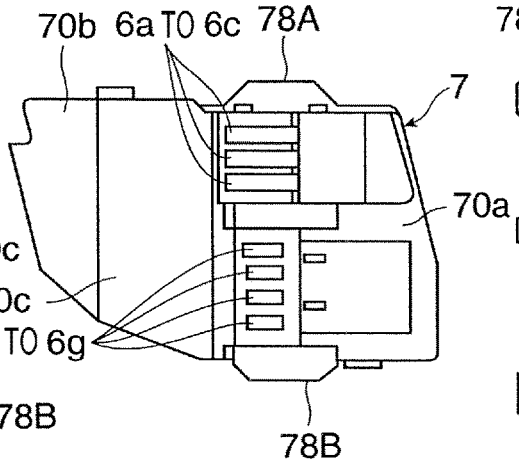
Figure 6C:
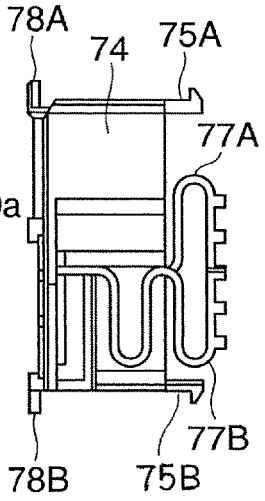
Figure 6E:
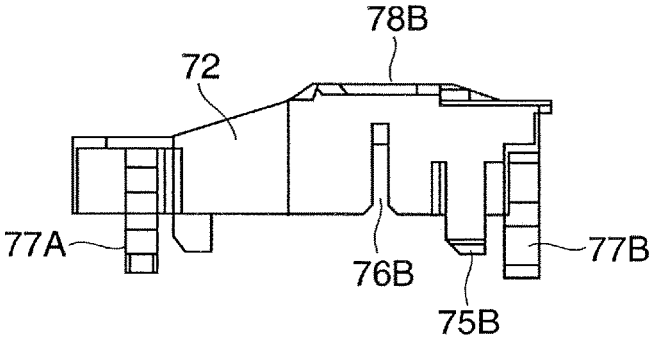

As shown in, for example, FIGS. 5 and 6, the holding member 7 is a structural member including a side surface 70 that is substantially parallel to the side surface portion 211 of the removable unit 20, and an upper surface 71, a lower surface 72, a front surface 73, and a rear surface 74 that intersect an upper end portion, a lower end portion, a front end portion, and a rear end portion of the side surface 70, respectively. The front surface 73 is a surface that is positioned at a downstream-side end portion in the movement direction D1 of the removable unit 20 when the removable unit 20 is mounted. The overall shape and dimensions of the holding member 7 are set such that substantially the entire holding member 7 is accommodated in an accommodation space of the mounting portion 260 at the side surface portion 211 of the removable unit 20. The holding member 7 is secured with the outer portions of contact surfaces of the second connection terminals 6*a* to 6*g* being exposed and arranged in a column in a vertical direction at a portion 70*a* (rear side) of the side surface 70.

In the holding member 7, an upper fitting protrusion 75A and a linear upper guiding groove 76A are provided in the upper surface 71, and a lower fitting protrusion 75B and a linear lower guiding groove 76B are provided in the lower surface 72. The upper fitting protrusion 75A and the lower fitting protrusion 75B are fitted to respective guiding holes 264A and 264B of the mounting portion 260 of the removable unit 20. Linear guiding protrusions 262 and 263 of the mounting portion 260 of the removable unit 20 are fitted to the upper guiding groove 76A and the lower guiding groove 76B.

In the holding member 7, a front elastic deforming portion 77A and a rear elastic deforming portion 77B are provided at an outer side of the front surface 73 and an outer side of the rear surface 74, respectively, at a back-surface side of the side surface 70. The front elastic deforming portion 77A and the rear elastic deforming portion 77B, serving as elastic members, protrude at the rear-surface side of the side surface 70. The front elastic deforming portion 77A and the rear elastic deforming portion 77B are each formed as a member that is formed from a leaf spring bent in a wavy shape. The front elastic deforming portion 77A and the rear elastic deforming portion 77B are formed such that respective free ends 77Ac and 77Bc are capable of contacting an inner wall surface 265 of the mounting portion 260 when the holding member 7 is being mounted on the mounting portion 260 of the removable unit 20.

Further, in the holding member 7, an upper fitting protrusion 78A is provided at an upper end of the side surface 70, and a lower fitting protrusion 78B is provided at a lower end of the side surface 70. The upper fitting protrusion 78A is a plate-like member that protrudes upward by a required length from the upper surface 71 at the upper end of the side surface 70, and that protrudes slightly outward from the side surface 70. The lower fitting protrusion 78B is a plate-like member that protrudes downward by a required length from the lower surface 72 at the lower end of the side surface 70, and that protrudes slightly outward from the side surface 70. The upper fitting protrusion 78A and the lower fitting protrusion 78B each have a side surface portion 78*c*, serving as a surface that protrudes slightly outward from the side surface 70 and that contacts a contact section 15, which is provided at the mounting section 12 (described below). Therefore, the side surface portions 78*c* prevent the second connection terminals 6*a* to 6*g* that exist inwardly of the side surface 70 from contacting the contact section 15.

Figure 4:
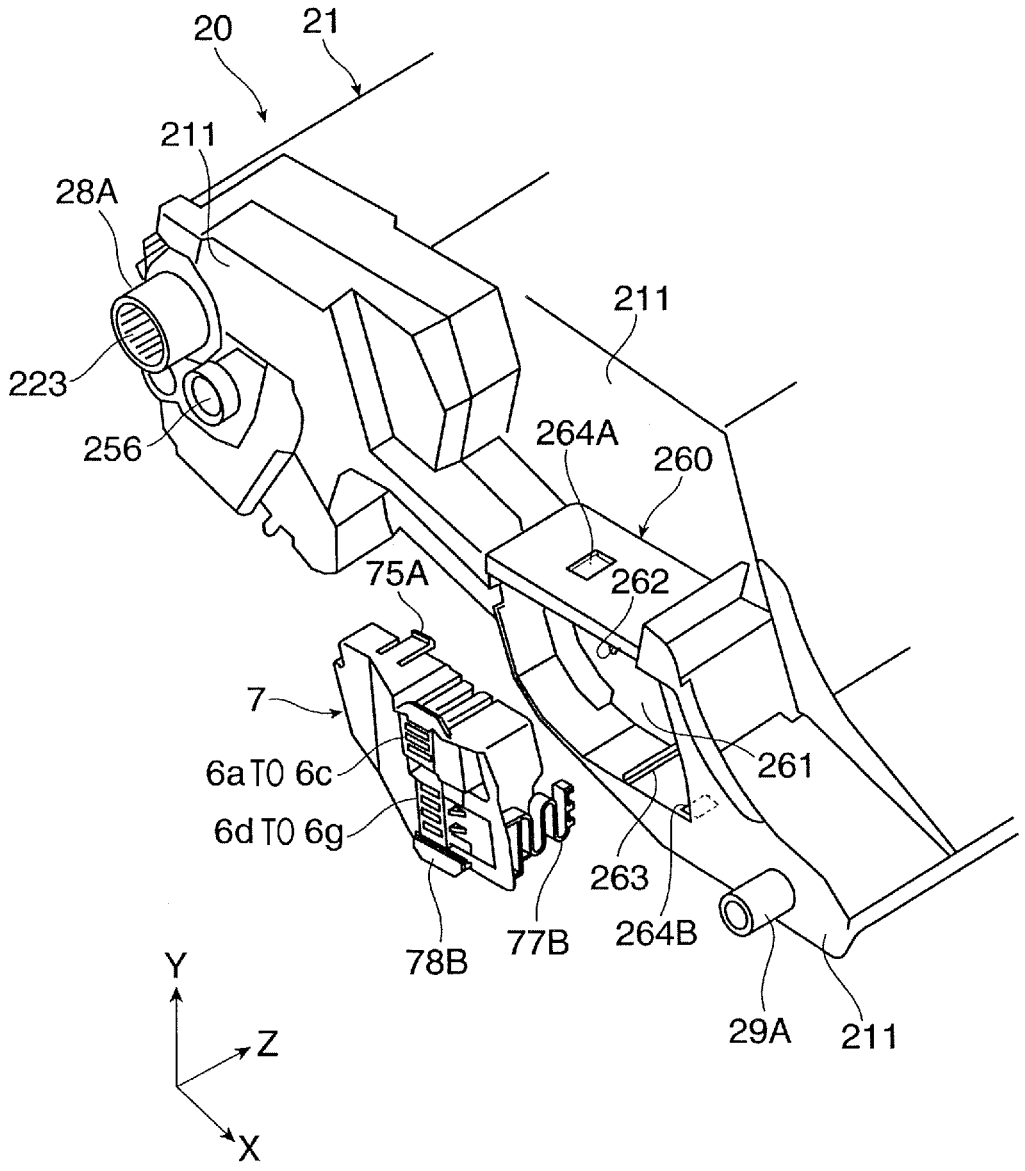
FIG. 4 is an exploded perspective view of a principal portion showing a structure of a side surface portion of the removable unit shown in FIG. 2 in relation to second connection terminals and a holding member, which are disposed at the side surface portion.

As shown in, for example, FIG. 4, the mounting portion 260 at the side surface portion 211 of the removable unit 20 is formed as a member having an accommodation space 261 having a shape and size that allow almost the entire holding member 7 to be accommodated except the side surface 70 of the holding member 7.

The mounting portion 260 is provided with the upper guiding protrusion 262 and the lower guiding protrusion 263, respectively, at an inner side of an upper surface portion and at an inner side of a lower surface portion, the upper surface portion and the lower surface portion surrounding and forming the accommodation space 261. The upper guiding protrusion 262 and the lower guiding protrusion 263 are provided for mounting the holding member 7 such that the holding member 7 is displaceable in the accommodation space 261 in directions H1 and H2 (directions that are substantially along the direction of arrow Z of the coordinate axis or the direction along the rotary shaft of the photoconductor drum 22) that are substantially orthogonal to the movement directions D1 and D2 of the removable unit 20 when the removable unit 20 is mounted and removed. The upper guiding protrusion 262 and the lower guiding protrusion 263 are formed as linear protruding portions in the displacement directions H1 and H2 of the holding member 7.

The upper guiding hole 264A and the lower guiding hole 264B into which the upper fitting protrusion 75A and the lower fitting protrusion 75B of the holding member 7 are fitted, respectively, are provided in the upper surface portion and the lower surface portion of the mounting portion 260. The upper guiding hole 264A and the lower guiding hole 264B are formed as rectangular through holes in plan view. Lengths m (see FIG. 7) of the upper guiding hole 264A and the lower guiding hole 264B along the displacement directions H1 and H2 of the holding member 7 are set to values that are in accordance with the length of the range in which the holding member 7 is displaceable.

Figure 7:
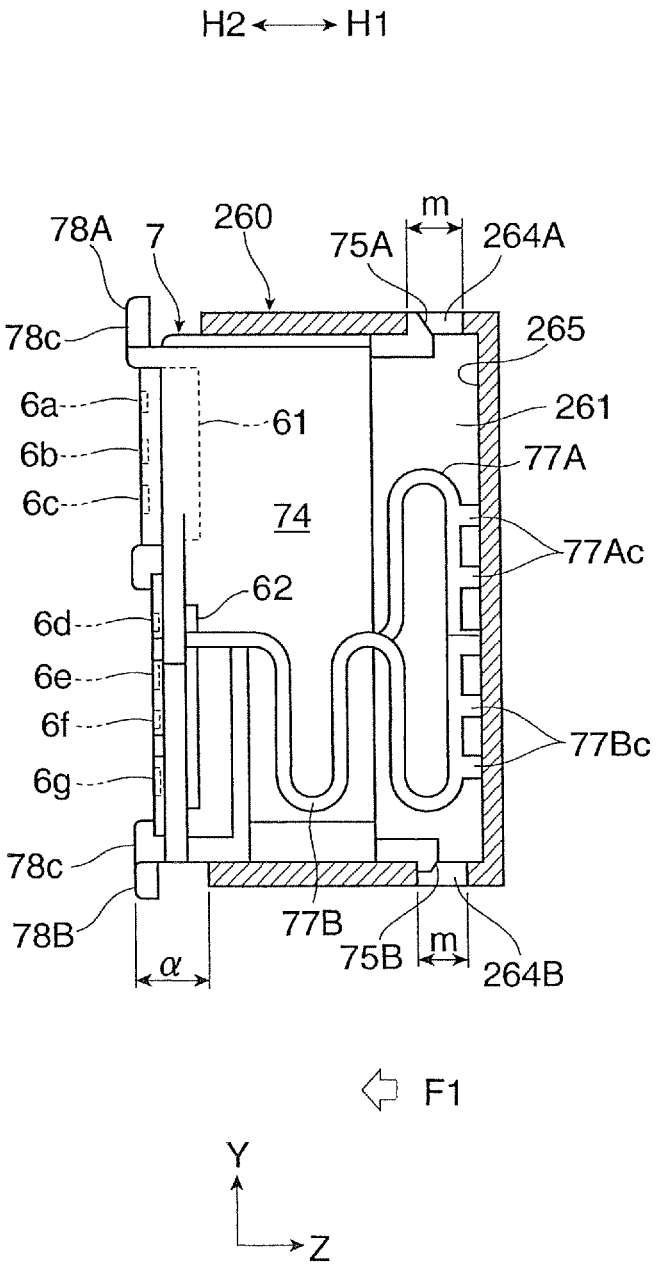
FIG. 7 is a partial sectional explanatory view of a state in which the second connection terminals and the holding member are mounted on a mounting portion at the side surface portion of the removable unit.

As shown in, for example, FIG. 2, FIG. 4, and FIG. 7, the holding member 7 that holds the second connection terminals 6*a* to 6*g* is mounted while being accommodated in the accommodation space 261 of the mounting portion 260 at the side surface portion 211 of the removable unit 20.

As shown in, for example, FIG. 7, the holding member 7 is mounted by, after the upper guiding protrusion 262 and the lower guiding protrusion 263 of the mounting portion 260 have been fitted into the upper guiding groove 76A and the lower guiding groove 76B of the holding member 7, respectively, pushing the entire holding member 7 into the accommodation space 261 of the mounting portion 260 and fitting the upper fitting protrusion 75A and the lower fitting protrusion 75B of the holding member 7 into the upper guiding hole 264A and the lower guiding hole 264B of the mounting portion 260, respectively.

When the mounting of the holding member 7 has been completed, the second connection terminals 6*a* to 6*g* that are held by the portion 70*a* of the side surface of the holding member 7 are exposed to the outside from the side surface portion 211 of the removable unit 20. When the mounting of the holding member 7 has been completed, the holding member 7 is kept in a protruding state by a required length a (see FIG. 7) at an outer side of the side surface portion 211 (or the mounting portion 260). Here, the protrusion amount a of the holding member 7 corresponds to the amount by which the side surfaces of the fitting protrusions 78A and 78B protrude from outer end portions of the mounting portion 260.

When the holding member 7 is mounted on the mounting portion 260, as shown in FIG. 7, the free end 77Ac of the front elastic deforming portion 77A of the holding member 7 and the free end 77Bc of the rear elastic deforming portion 77B of the holding member 7 contact the inner wall surface 265 that exists at a far side of the accommodation space 261 of the mounting portion 260. Here, since the front elastic deforming portion 77A and the rear elastic deforming portion 77B become slightly elastically deformed, the holding member 7 is subjected to an elastic force (spring force) F1 of the front elastic deforming portion 77A and the rear elastic deforming portion 77B. Accordingly, in the accommodation space 261 of the mounting portion 260, the holding member 7 is kept elastically pushed in the displacement direction H2, which is also a direction towards the outer side of the side surface portion 211 (or the mounting portion 260) of the removable unit 20.

Figure 8:
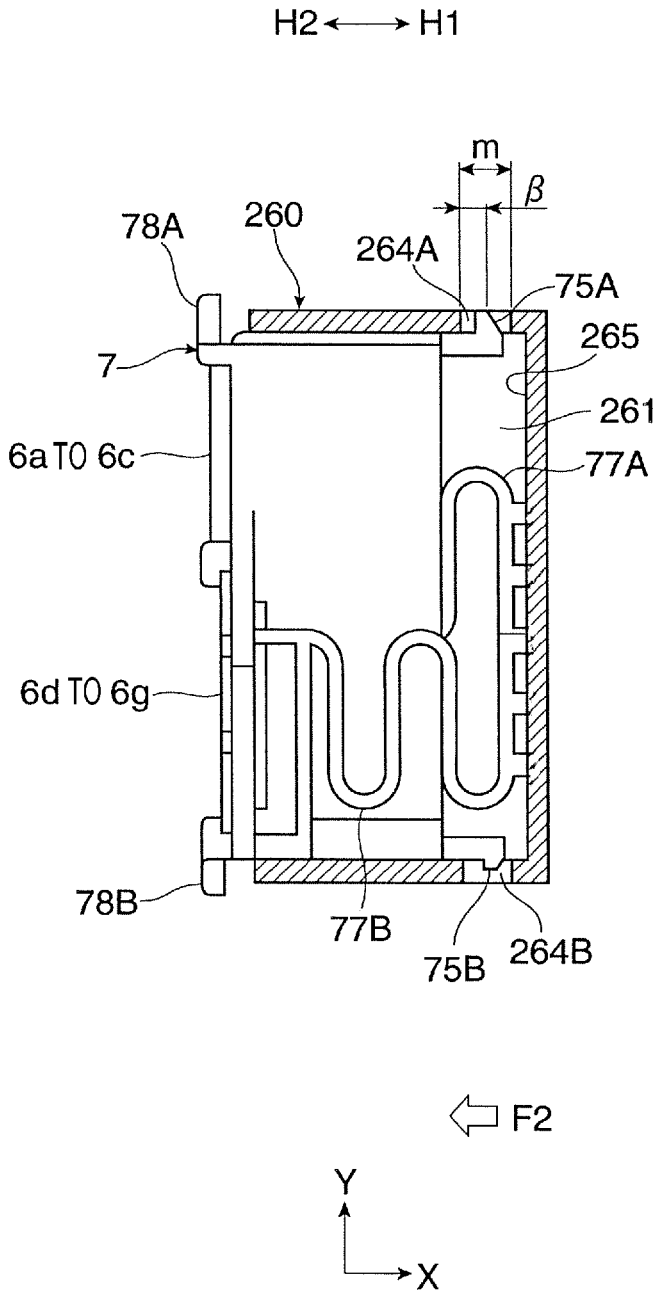
FIG. 8 is a partial sectional explanatory view of a state in which the second connection terminals and the holding member shown in FIG. 7 are displaceable towards an inner side of the mounting portion.

Further, when the holding member 7 is mounted on the mounting portion 260, for example, when the holding member 7 is subjected to an external force acting from the outer side to an inner side of the side surface portion 211 (or the mounting portion 260) of the removable unit 20, as shown in FIG. 8, the holding member 7 is displaceable in the displacement direction H1, which is also a direction towards the inner side of the side surface portion 211 (or the mounting portion 260) of the removable unit 20, in the accommodation space 261 of the mounting portion 260.

In this case, as exemplified in FIG. 8, when the holding member 7 is displaced by a distance β in the displacement direction H1, the front elastic deforming portion 77A and the rear elastic deforming portion 77B are elastically deformed in accordance with the displaced distance β. Therefore, when the holding member 7 is subjected to a somewhat stronger elastic force F2 of the front elastic deforming portion 77A and the rear elastic deforming portion 77B in accordance with the displaced distance β, the holding member 7 is kept in a more strongly elastically pushed state in the displacement direction H2. The elastic force F2 at this time is greater than the elastic force F1 when external force is not applied (F2>F1).

Structure of Mounting Section for Removable Unit in Image Forming Apparatus

Figure 9:
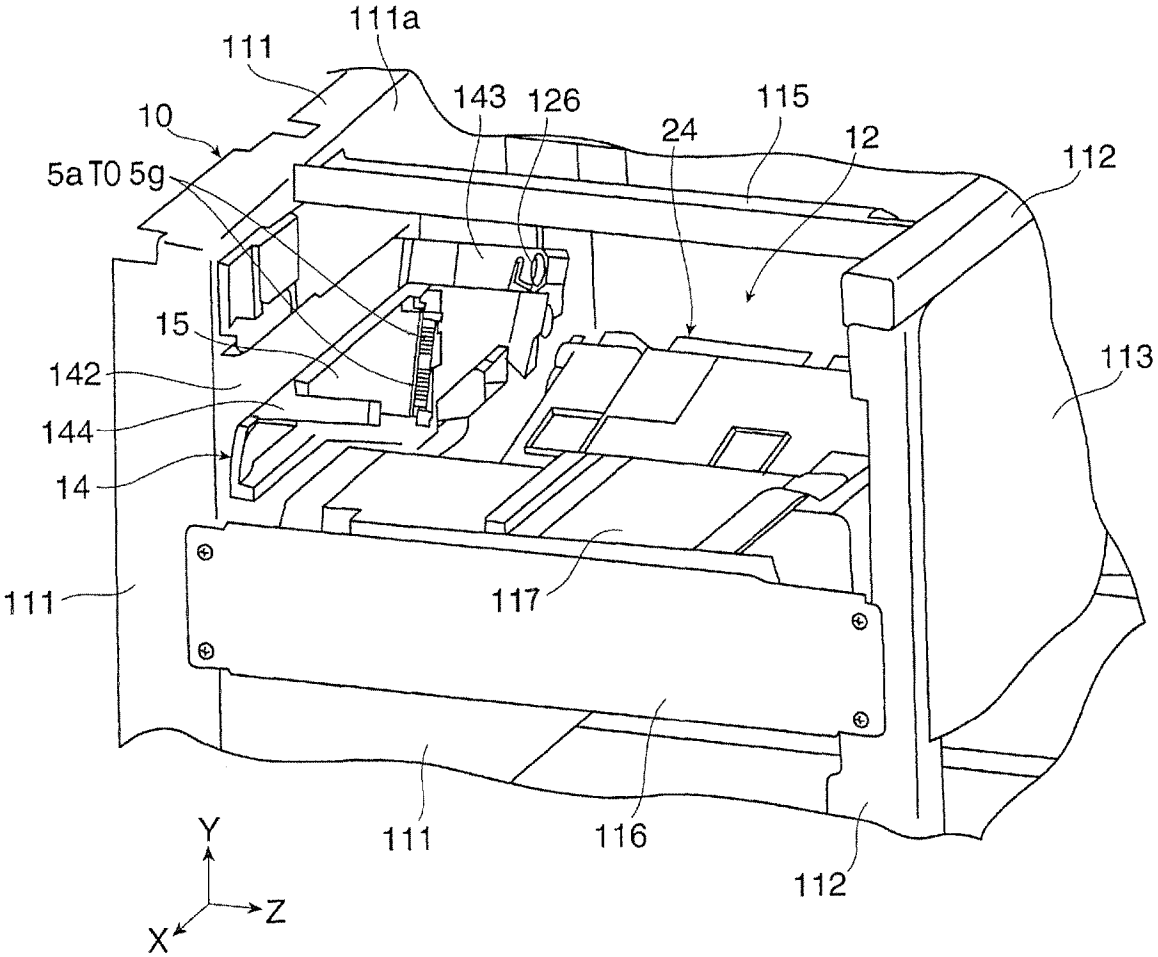
FIG. 9 is a perspective view of a principal portion showing the mounting section for the removable unit of the image forming apparatus shown in FIG. 1.

As shown in, for example, FIG. 9, in the image forming apparatus 1, the mounting section 12 for removably mounting the removable unit 20 is provided at a portion of the housing 10.

As shown in, for example, FIG. 9, the mounting section 12 has a space portion and a movement space, which form part of an internal space of the housing 10. The removable unit 20 that forms part of the image forming device 2 is mounted in the space portion. The removable unit 20 is capable of being moved in the movement space when the removable unit 20 is mounted or removed. In, for example, FIG. 9, reference numeral 111 denotes a side frame (which is also a support column), reference numeral 112 denotes an outer frame, reference numeral 113 denotes a side plate, reference numerals 115 and 116 denote a connecting frame and a linking plate that connect the side frame 111 and the outer frame 112 to each other, reference numeral 117 denotes a partition frame, and reference numeral 14 denotes a guiding supporting member that guides and supports the side surface portion 211 of the removable unit 20 when the removable unit 20 is mounted or removed.

In the mounting section 12, the guiding supporting member 14 is mounted on an inner-surface side of the side frame 111. As shown in, for example, FIGS. 9 and 10, the guiding supporting member 14 includes an introducing guiding groove 142, a first mounting guiding groove 143, and a second mounting guiding groove 144. The introducing guiding groove 142 introduces and guides the first protrusion 28A of the removable unit 20 up to a mounting-operation start position. The first mounting guiding groove 143 guides the first protrusion 28A that has been introduced to and has reached the mounting-operation start position through the introducing guiding groove 142 to a normal mounting position (at the same time, the input-side connecting member 223 of the photoconductor drum 22 is also guided to the normal mounting position as well). The second mounting guiding groove 144 guides the second protrusion 29A of the removable unit 20 up to a normal positioning position. In the mounting section 12, a guiding supporting member that has substantially the same structure as the guiding supporting member 14 is also mounted on an inner-surface side of the side plate 113 that is situated opposite to and opposes the side frame 111.

The introducing guiding groove 142 is formed as a linear groove extending substantially in a horizontal direction (which is a direction substantially parallel to the direction of arrow X of the coordinate axis) from one side surface of the housing 10 (that is, the side surface of the housing 10 at the side where the entrance opens for mounting the removable unit 20) towards the inside of the housing 10. Although the bottom surface defining the introducing guiding groove 142 is formed from an inner surface of the side frame 111, the bottom surface may be formed from part of the guiding supporting member 14.

Figure 10:
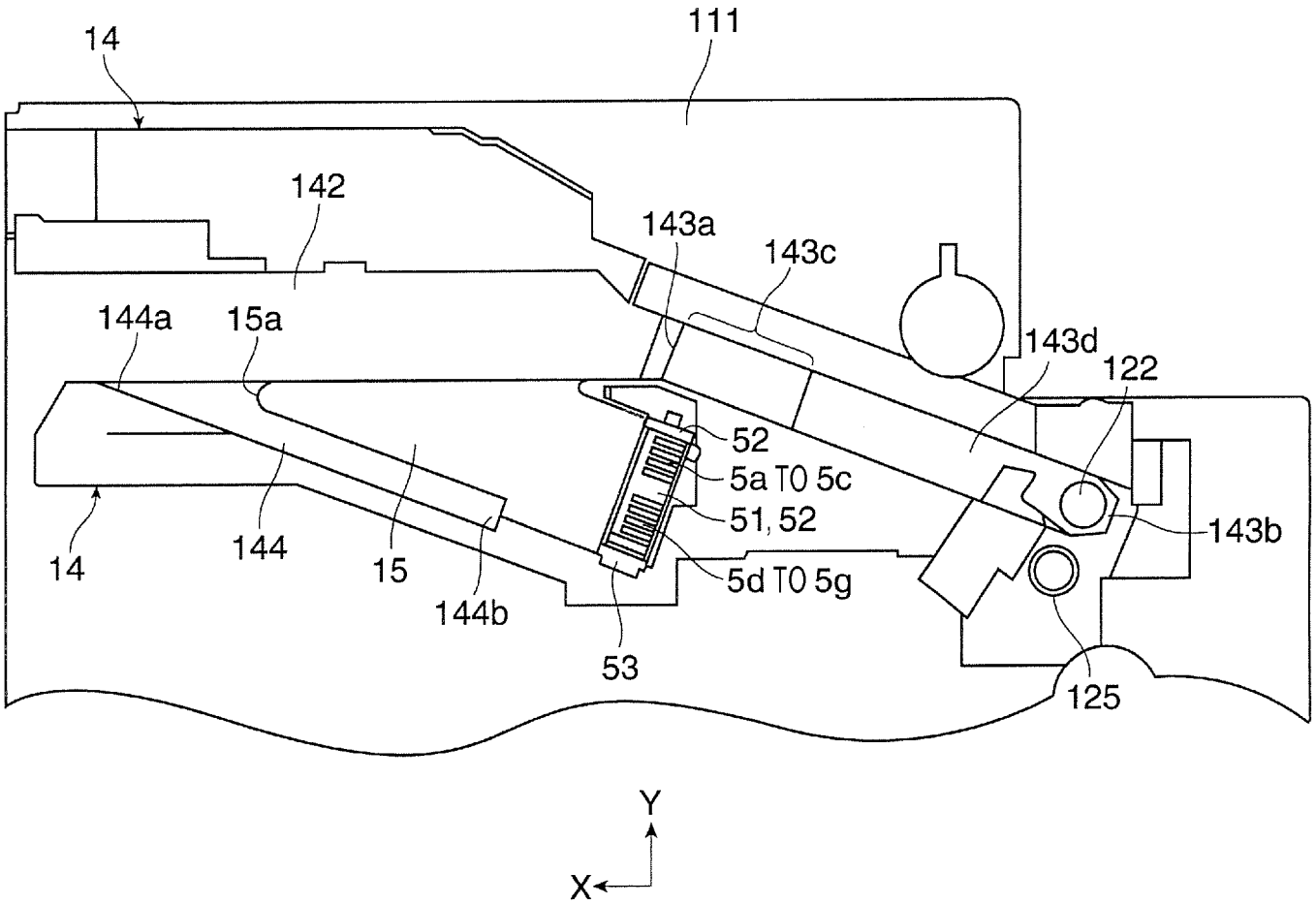
FIG. 10 is an explanatory view of a principal portion showing a structure of the mounting section shown in FIG. 8 when the removable unit is mounted or removed and showing a state of arrangement of first connection terminals.

As shown in FIG. 10, the first mounting guiding groove 143 is formed as a linearly inclined groove including a guide start portion 143*a* and extending obliquely downward from the guide start portion 143*a* at a predetermined angle, with a terminal end portion that is positioned at a far side of the introducing guiding groove 142 being the guide start portion 143*a*. In the first mounting guiding groove 143, a drive-side connecting member 122 is disposed at a guide terminal end portion 143*b* that is situated at the lowest position. The input-side connecting member 223 of the photoconductor drum 22 enters and is connected to the drive-side connecting member 122. Reference numeral 125 in FIG. 10 denotes a drive-side connecting member. The input-side connecting member 256 (see FIG. 2) of the developing device 25 enters and is connected to the drive-side connecting member 125.

As shown in FIG. 10, the second mounting guiding groove 144 is formed as a linearly inclined groove including a guide start portion 144*a* and extending obliquely downward from the guide start portion 144*a* at an angle that is the same as that of the first mounting guiding groove 143, with a portion of the introducing guiding groove 142 that is situated adjacent to the entrance being the guide start portion 144*a*. For example, the guide start portion 144*a* of the second mounting guiding groove 144 is set at a position that is reached by the second protrusion 29A of the removable unit 20 when the first protrusion 28A of the removable unit 20 reaches or starts entering the guide start portion 143*a* of the first mounting guiding groove 143. A guide terminal end portion 144*b* of the second mounting guiding groove 144 is set at a position where the second protrusion 29A of the removable unit 20 is to be positioned.

Figure 11:
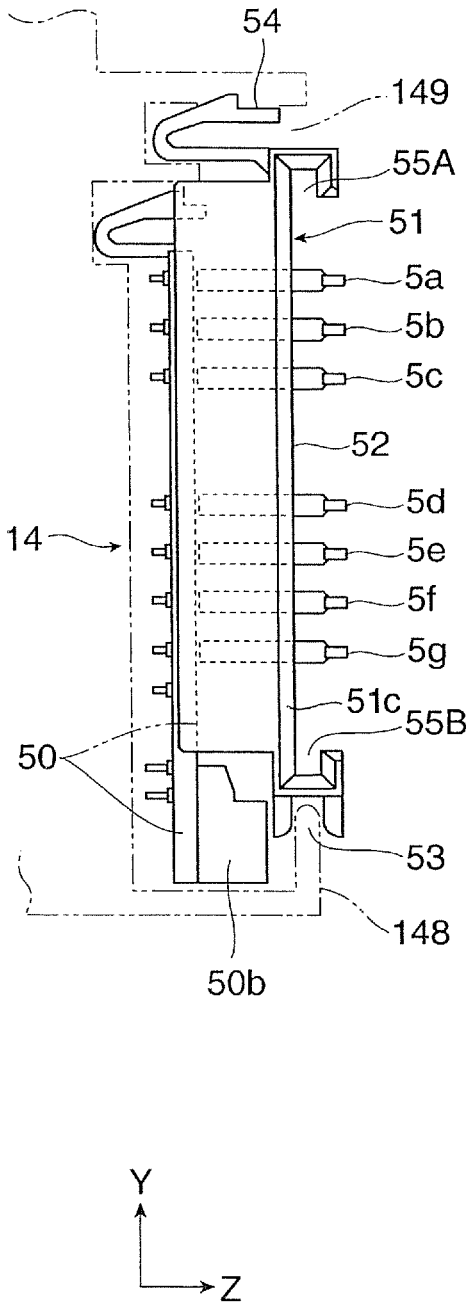
FIG. 11 is an explanatory view of a principal portion when the state of the arrangement of the first connection terminals shown in FIG. 10 is viewed from a different angle.

As shown in, for example, FIGS. 9 to 11, in the mounting section 12, the first connection terminals 5*a* to 5*g* are disposed at the inner-surface side of the side frame 111. The second connection terminals 6*a* to 6*g* at the removable unit 20 contact and are electrically connected with the first connection terminals 5*a* to 5*g*. In the exemplary embodiment, the first connection terminals 5*a* to 5*g* are disposed at part of the guiding supporting member 14 that is mounted on the inner-surface side of the side frame 111.

The first connection terminals 5*a* to 5*g* are each formed as a protruding terminal that is made of a conductive material, such as a metal, and that protrudes by a required amount from an inner side of the mounting section 12. As shown in, for example, FIGS. 10 and 11, the first connection terminals 5*a* to 5*g* are mounted on a wiring board 50 and are, along with the wiring board 50, held by a holding member 51.

Three of the five first connection terminals 5, that is, the first connection terminals 5*a* to 5*c* are used as terminals that contact the second connection terminals 6*a* to 6*c* of the removable unit 20 and that perform input/output of electronic information with the electronic component 61 (see FIG. 7). The remaining four first connection terminals 5*d* to 5*g* are used as terminals that contact the second connection terminals 6*d* to 6*g* of the removable unit 20 and that perform input/output of electronic information with the different electronic component 62 (see FIG. 7). A connector terminal to which a wiring member (such as a harness) is connected is disposed at a lower end portion 50*b* of the wiring board 50, with, for example, an electronic substrate and a controller (not shown) provided at the side of the image forming apparatus 1 being connected to the wiring member. As shown in, for example, FIG. 12, the first connection terminals 5*a* to 5*g* according to the exemplary embodiment are elastically deformable so as to fall in a curved form after the first connection terminals 5*a* to 5*g* have protruded from a surface of the holding member 51 that faces the mounting section 12. This allows the first connection terminals 5*a* to 5*g* to contact and to be connected with the second connection terminals 6*a* to 6*g* while the first connection terminals 5*a* to 5*g* have fallen in a curved form towards a downstream side in the direction of arrow D1 in which the removable unit 20 is inserted when the removable unit 20 is being mounted.

As shown in, for example, FIG. 11, the holding member 51 is a structural member having the form of a thick plate including a rectangular inner side surface 52 that is substantially parallel to the inner surface of the side frame 111 of the mounting section 12. In addition, the holding member 51 secures contact surfaces of the first connection terminals 5*a* to 5*g* arranged in a column in a vertical direction in a portion of an inner-side side surface 52 of the holding member 51 while the first connection terminals 5*a* to 5*g* protrude from the inner-side side surface 52.

The holding member 51 is provided with a fitting groove 53 at a lower end portion thereof. The fitting groove 53 is fitted onto a mounting protrusion 148 of the guiding supporting member 14. The holding member 51 is also provided with a securing protrusion 54 at an upper end portion thereof. The securing protrusion 54 is fitted and secured to a mounting hole portion 149 of the guiding supporting member 14.

The holding member 51 includes an upper fitting groove 55A and a lower fitting groove 55B in an upper end portion and the lower end portion of the holding member 51, respectively. The upper fitting protrusion 78A and the lower fitting protrusion 78B of the holding member 7 of the removable unit 20 are fitted into the upper fitting groove 55A and the lower fitting groove 55B, respectively. The upper fitting groove 55A and the lower fitting groove 55B extend in the movement direction D1 of the removable unit 20 when the removable unit 20 is mounted (that is, a guiding direction in which the second mounting guiding groove 144 is inclined).

Further, the holding member 51 includes a guiding surface 51*c* at one side end portion thereof. The guiding surface 51*c* guides the holding member 7 of the removable unit 20 so as to allow the holding member 7 to slightly move thereon, and smoothly guides the upper fitting protrusion 78A and the lower fitting protrusion 78B to the upper fitting groove 55A and the lower fitting groove 55B, respectively (see FIGS. 11 to 13). The one end portion is a side end portion that is positioned at a side towards which the removable unit 20 moves when the removable unit 20 is mounted or away from which the removable unit 20 moves when the removable unit 20 is removed.

As shown in, for example, FIGS. 10 and 11, the holding member 51 that holds the first connection terminals 5*a* to 5*g* are mounted in a fixed state at mounting positions for the connection terminals by fitting the fitting groove 53 onto the mounting protrusion 148 and securing the securing protrusion 54 to the mounting hole portion 149. The mounting positions are set at the guiding supporting member 14 of the mounting section 12.

The first connection terminals 5*a* to 5*g* are disposed at required positions in the mounting section 12 so as to be aligned with the positions of the second connection terminals 6*d* to 6*g* of the removable unit 20 that is mounted on the mounting section 12. In the exemplary embodiment, the second connection terminals 6*d* to 6*g* are as a whole inclined in the forward direction such that the upper end side of the second connection terminals 6*d* to 6*g* exists downstream from the lower end side of the second connection terminals 6*d* to 6*g* in the movement direction D1 of the removable unit 20 when mounting the removable unit 20. The second connection terminals 6*d* to 6*g* are disposed so as to exist between the first mounting guiding groove 143 and the second mounting guiding groove 144 of the guiding supporting member 14 (see FIGS. 2, 10, and 13).

Figure 12:
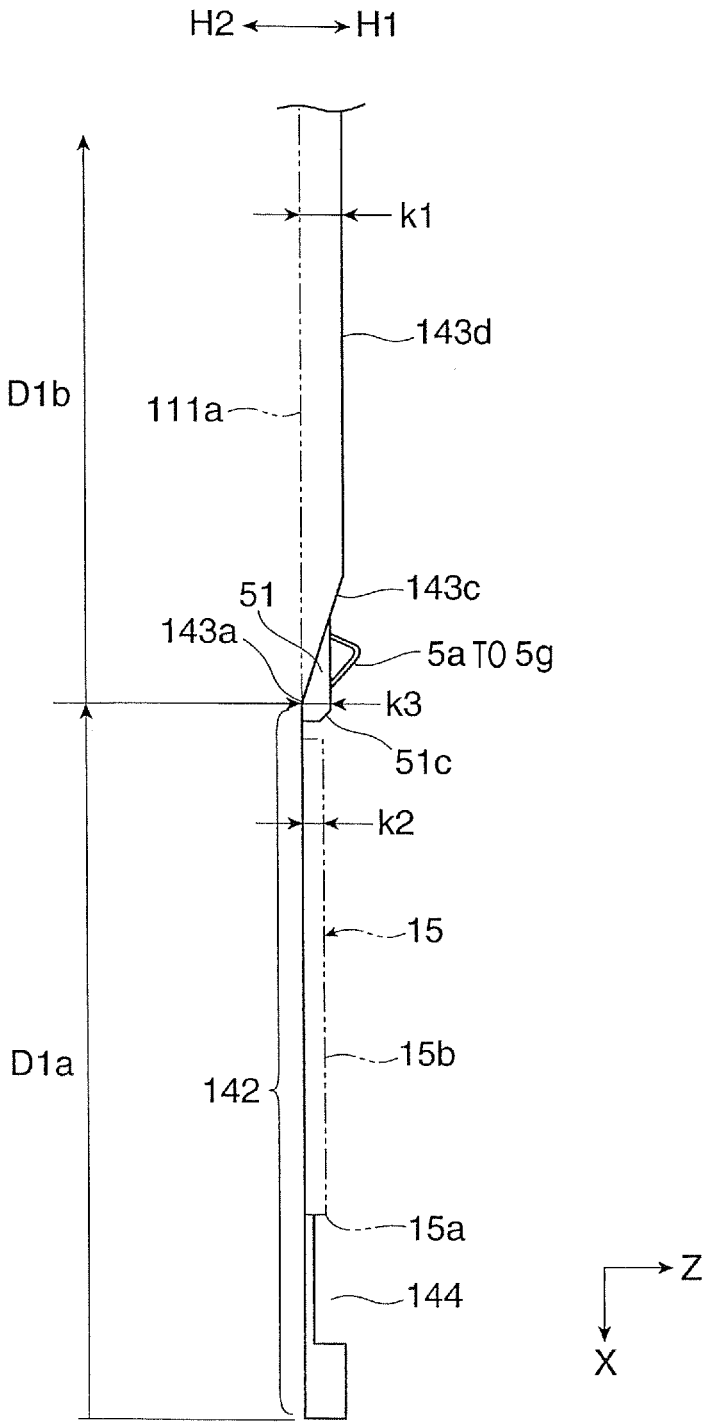
FIG. 12 is an explanatory view of a structure of, for example, mounting guiding grooves and a contact section that are used when the removable unit is mounted on or removed from the mounting section shown in FIG. 8.

As shown in, for example, FIG. 12, a bottom surface of the first mounting guiding groove 143 of the guiding supporting member 14 of the mounting section 12 is formed by an inclined guiding surface portion 143*c* and a steady guiding surface portion 143*d*.

The inclined guiding surface portion 143*c* is formed as a inclined surface in which the bottom surface of the guiding groove extending to a required distance from the guide start portion 143*a* of the first mounting guiding groove 143 gradually extends upward (is displaced) towards the inner side of the mounting section 12 from an inner-side surface (reference surface) 111*a* of the side frame 111 of the mounting section 12. The steady guiding surface portion 143*d* is a flat guiding surface portion in which the bottom surface of the guiding groove extending to a topmost position (terminal end) of the inclined guiding surface portion 143*c* and to the terminal end portion 143*b* of the first mounting guiding groove 143 is displaced by a certain distance (displacement amount) k1 from the inner-side surface 111*a* of the side frame 111 of the mounting section 12. The steady guiding surface portion 143*d* is formed so as to guide the removable unit 20 while the steady guiding surface portion 143*d* is displaced by the required distance (displacement amount k1) from the inner-side surface 111*a* of the side frame 111 in order to prevent the side surface portion 211 of the removable unit 20 from unnecessarily contacting or colliding with other structural components (such as a driving coupling mechanism of the developing device) that slightly protrude into the inner side of the mounting section 12.

The contact section 15 is provided at the guiding supporting member 14 of the mounting section 12. When the removable unit 20 is mounted or removed, the contact section 15 contacts the holding member 7 and keeps the holding member 7 displaced towards the inner side of the side surface portion 211 of the removable unit 20.

The contact section 15 is formed as a structural section including a smooth contact surface 15*b* disposed between the introducing guiding groove 142 and the second mounting guiding groove 144 so as to reach the positions of the first connection terminals 5*a* to 5*g*. The contact surface 15*b* is displaced by a predetermined distance (displacement amount) k2 from the inner-side surface (reference surface) 111*a* of the side frame 111 of the mounting section 12 towards the inner side of the mounting section 12. In the contact section 15, an end portion 15*a*, which is to be positioned at an upstream side in the movement direction D1 of the removable unit 20 when the removable unit 20 is mounted (that is, a location corresponding to the location of the guide start portion 144*a* of the second mounting guiding groove 144), is rounded. When the removable unit 20 is mounted or removed, the contact surface 15*b* of the contact section 15 contacts a portion of the side surface 70 of the holding member 7 that holds the second connection terminals 6*a* to 6*g* of the removable unit 20 (that is, a guiding surface portion 70*c* and the side surfaces 78*c* of the fitting protrusions 78).

Incidentally, as shown in FIG. 12, the first connection terminals 5*a* to 5*g* are disposed so as to be displaced by a required distance (displacement amount) k3 towards the inner side of the mounting section 12 from the inner-side surface (reference surface) 111*a* of the side frame 111 of the mounting section 12. The displacement amount k3 at this time is set so as to prevent the first connection terminals 5*a* to 5*g* from colliding with the side surface portion 211 of the removable unit 20 before the first connection terminals 5*a* to 5*g* contact the second connection terminals 6*a* to 6*g* of the removable unit 20. The displacement amount k3 of the first connection terminals 5*a* to 5*g* is greater than the displacement amount k2 of the contact section 15 (k3>k2) because the height of the guiding surface 51*c* of the holding member 51 is greater than that of the contact surface 15*b* of the contact section 15 (see FIG. 12).

As shown in, for example, FIGS. 5 and 6A, 6B, and 6D, the side surface 70 of the holding member 7 at the removable unit 20 includes a first side surface portion 70*b* and the guiding surface portion 70*c*. The first side surface portion 70*b* is a downstream-side portion in the movement direction D1 of the removable unit 20 when the removable unit 20 is mounted. The guiding surface portion 70*c* is a portion that extends from the first side surface portion 70*b* to the side surface portion 70*a* where, for example, the second connection terminals 6*d* to 6*g* are disposed.

The first side surface portion 70*b* is a side surface that contacts the contact surface 15*b* of the contact section 15 of the mounting section 12 so as to slide along the contact surface 15*b* when the removable unit 20 is being mounted. The guiding surface portion 70*c* is formed as a side surface that, when the removable unit 20 is being mounted, contacts the end portion 15*a* of the contact section 15 of the mounting section 12, and guides the entire holding member 7 so as to be gradually displaced towards the inner side of the side surface portion 211 of the removable unit 20 (actually, the inner side of the mounting portion 260). The guiding surface portion 70*c* terminates at a point where it reaches the side surface portion 70*a* where, for example, the second connection terminals 6*a* to 6*g* are disposed (strictly speaking, a side surface 75*c* of the fitting protrusion 75). As shown in, for example, FIG. 6D, the guiding surface portion 70*c* is provided such that the amount of displacement (level difference) j from the first side surface portion 70*b* towards an outer side of the side surface portion 211 of the removable unit 20 is set to a required value.

The level difference j at this time allows the distance of displacement of the holding member 7 that holds the second connection terminals 6*a* to 6*g* towards the inner side of the mounting portion 260 when the removable unit 20 is being mounted to be provided. The side surface 78*c* of the upper fitting protrusion 78A of the holding member 7 and the side surface 78*c* of the lower fitting protrusion 78B of the holding member 7 have sizes that allow them to move while being placed on and contacting the contact surface 15*b* of the contact section 15 of the mounting section 12 when the removable unit 20 is being mounted.

Mounting of Removable Unit on Mounting Section

The removable unit 20 is mounted on the mounting section 12 of the image forming apparatus 1 as follows.

First, by grasping and raising the handle 217, the removable unit 20 is held while an end portion, which is a leading end in the movement direction D1 of the removable unit 20 when the removable unit 20 is being mounted, is close to the mounting section 12. Then, the first protrusions 28A and 28B, which are left and right side surface portions, of the leading-end side portion are inserted into the introducing guiding grooves 142 of the guiding supporting members 14 on the left and right sides of the mounting section 12 (a guiding supporting member also exists on the right side as mentioned above), after which the entire unit is pushed into the internal space of the mounting section 12.

Figure 15:
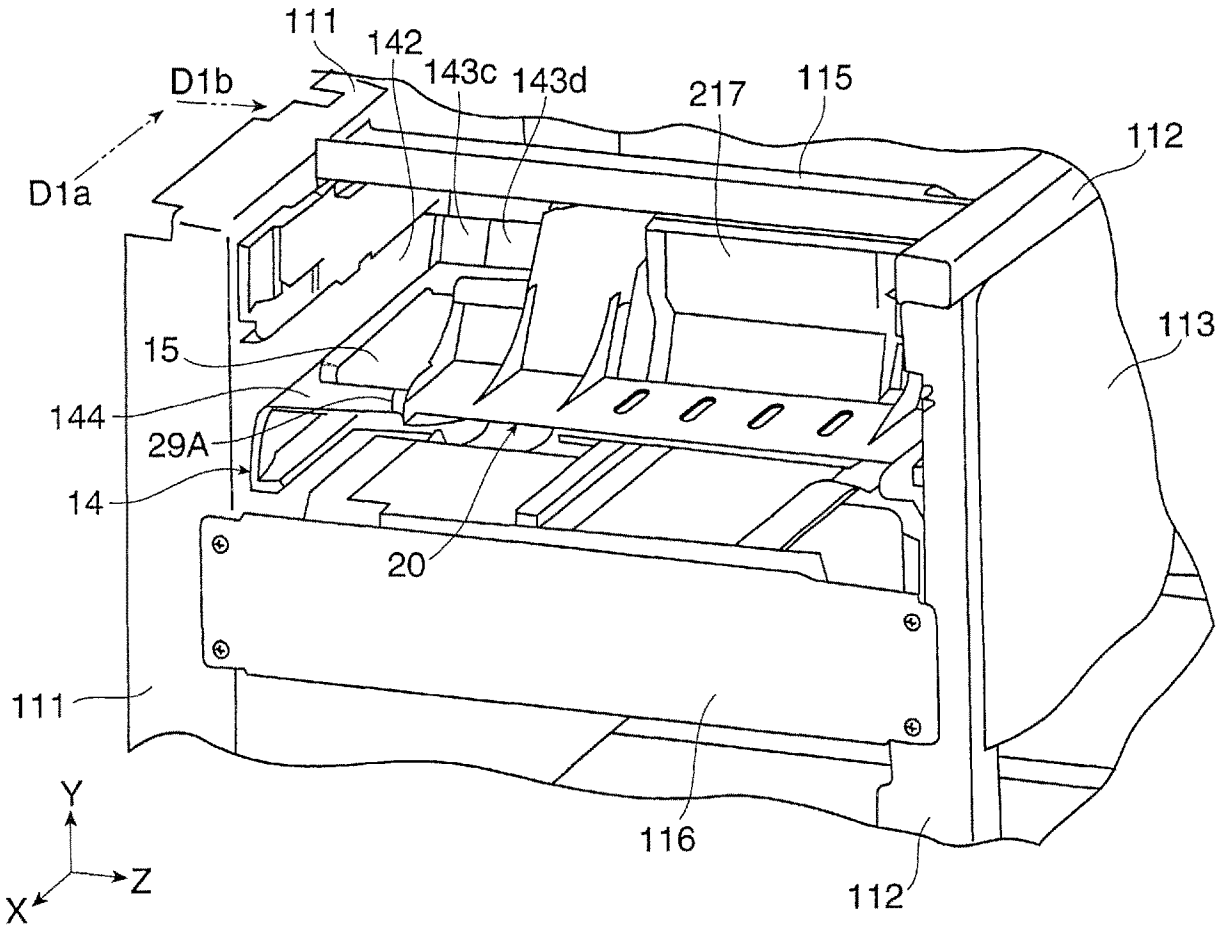
FIG. 15 is a perspective view of a principal portion showing a state when the removable unit has been mounted on the mounting section shown in FIG. 9.

In this case, as shown in, for example, FIGS. 12 and 15, the removable unit 20 is guided along the introducing guiding grooves 142 of the guiding supporting members 14, and moves substantially horizontally in the direction of arrow D1*a*.

Here, when the first protrusions 28A and 28B of the removable unit 20 move up to the terminal end portions of the introducing guiding grooves 142, and reach the entrances of the first mounting guiding grooves 143, the second protrusions 29A and 29B, which are left and right side end portions of a trailing end portion in the movement direction D1 of the removable unit 20 when the removable unit 20 is being mounted, enter the introducing guiding grooves 142, so that they are in a state in which they have reached the entrances of the second mounting guiding grooves 144.

At this stage, the holding member 7 that holds the second connection terminals 6*a* to 6*g* of the removable unit 20 move into the space of the introducing guiding groove 142 of the guiding supporting member 14, and are kept out of contact with the contact section 15 of the guiding supporting member 14.

Next, when the removable unit 20 is further pushed towards the far side of the internal space of the mounting section 12, the first protrusions 28A and 28B are guided along the first mounting guiding grooves 143 (strictly speaking, lower side portions of the guiding grooves), and the second protrusions 29A and 29B are guided along the second mounting guiding grooves 144 (strictly speaking, lower side portions of the guiding grooves), so that the unit as a whole moves towards the far side of the internal space of the mounting section 12 while gradually moving downward in the direction of arrow D1*b*.

Figure 13:
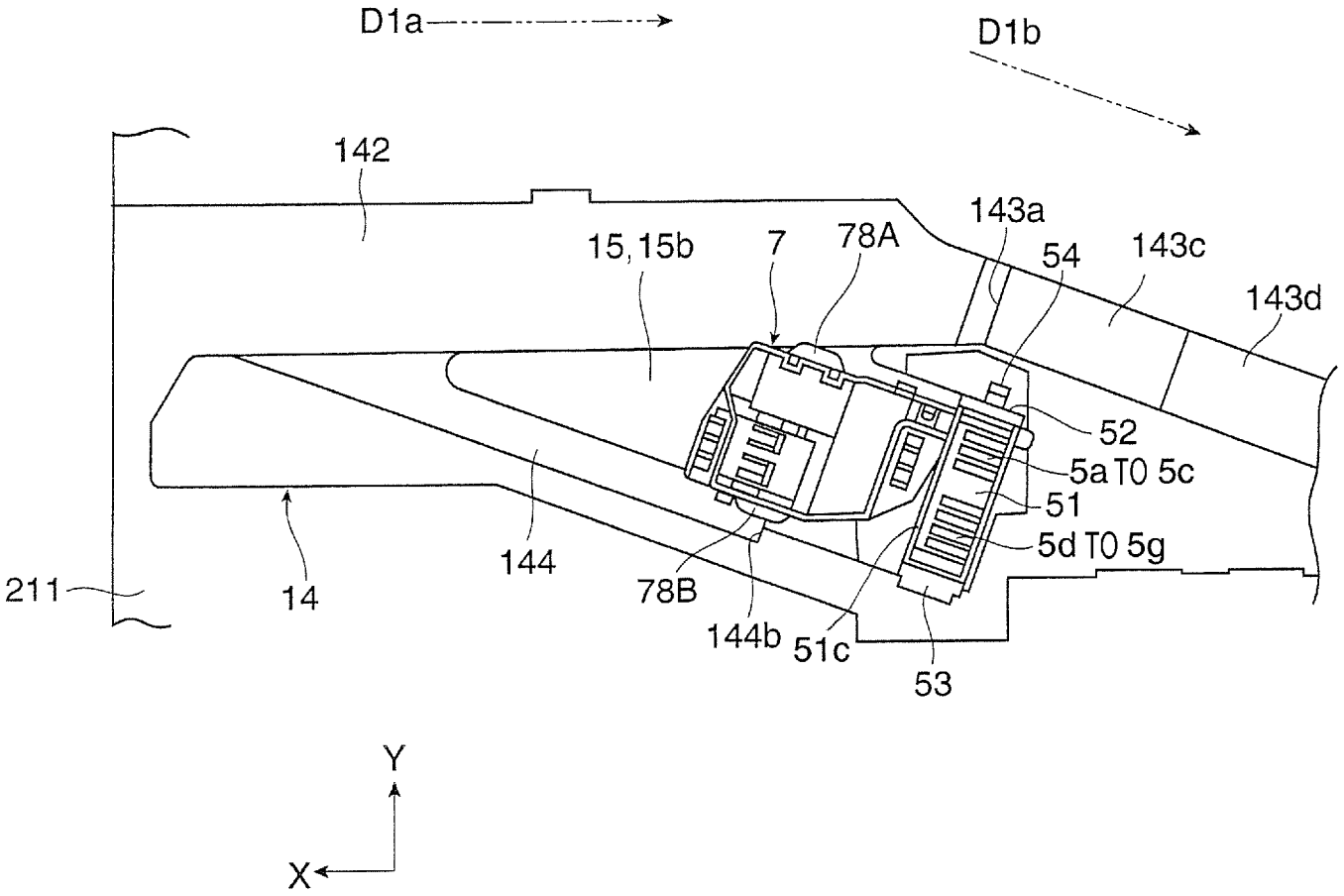
FIG. 13 is an explanatory view of a principal portion showing a state of the second connection terminals and the holding member when the removable unit is being mounted on the mounting section shown in FIG. 8.

At this time, as shown in, for example, FIGS. 12, 13, and 15, the removable unit 20 is guided along the first mounting guiding grooves 143 and the second mounting guiding grooves 144 (which are substantially parallel to each other) of the guiding supporting members 14 and move in a tilted state so as to gradually move obliquely downward towards the front in the direction of arrow D1*b*.

Here, as shown in, for example, FIG. 12, since the first protrusion 28A moves while contacting the inclined guiding surface portion 143*c*, which is at the entrance side of the first mounting guiding groove 143, the entire unit is guided while being displaced so as to gradually extend away from the inner-side surface (reference surface) 111*a* of the side frame 111 of the mounting section 12 towards the inner side of the mounting section 12. Thereafter, when the removable unit 20 reaches the steady guiding surface portions 143*d*, which are disposed behind the inclined guiding surface portions 143*c* of the first mounting guiding grooves 143, and moves while contacting the steady guiding surface portions 143*d*, the entire unit is guided while the entire unit is kept displaced up to the position where the required displacement amount becomes k1 from the inner-side surface 111*a* of the side frame 111 of the mounting section 12.

Further, at this stage, since the entire removable unit 20 moves so as to gradually move obliquely downward towards the front in the direction of arrow D1*b*, the holding member 7 that holds the second connection terminals 6*a* to 6*g* of the removable unit 20 also moves from the introducing guiding groove 142 of the guiding supporting member 14 towards the contact section 15, so that the holding member 7 moves while in contact with the contact section 15.

Here, when, after the first side surface portion 70*b* of the side surface 70 of the holding member 7 has passed the contact surface 15*b* while opposing the contact surface 15*b* of the contact section 15, the guiding surface portion 70*c* (which is an inclined surface situated behind the first side surface portion 70*b*) contacts the contact section 15 and moves so as to pass the contact section 15, the following occurs. That is, the holding member 7 is gradually pushed towards the inner side of the accommodation space 261 of the mounting portion 260 of the removable unit 20 against the elastic force F of the elastic deforming portions 77A and 77B, and starts to be displaced in the direction of arrow H1. The holding member 7 at this time is displaced towards the inner side of the accommodation space 261 of the mounting portion 260 from the contact surface 15*b* of the contact section 15 as a reference by an amount corresponding to the level difference j between the first side surface portion 70*b* and the guiding surface portion 70*c*. The holding member 7 is smoothly displaced by the gradual guiding of the guiding surface portion 70*c*. Therefore, even if, when the removable unit 20 is being mounted, the holding member 7 is displaced towards the inner side of the side surface portion 211 of the removable unit 20 (that is, the accommodation space 261 of the mounting portion 260), operability in mounting the removable unit 20 is not lost.

Here, when, as the removable unit 20 is tilted and moved in the direction of arrow D1*b*, the side surface portion 70*a* of the side surface 70 of the holding member 7 that holds the second connection terminals 6*a* to 6*g* comes into contact with the contact surface 15*b* of the contact section 15, the following occurs. That is, at this stage, as shown in FIGS. 13 and 14, the side surface 78*c* of the fitting protrusion 78A (at an upper end portion of the side surface 70) and the side surface 78*c* of the fitting protrusion 78B (at the lower end portion of the side surface 70) move while in contact with the contact surface 15*b* of the contact section 15.

Figure 14:
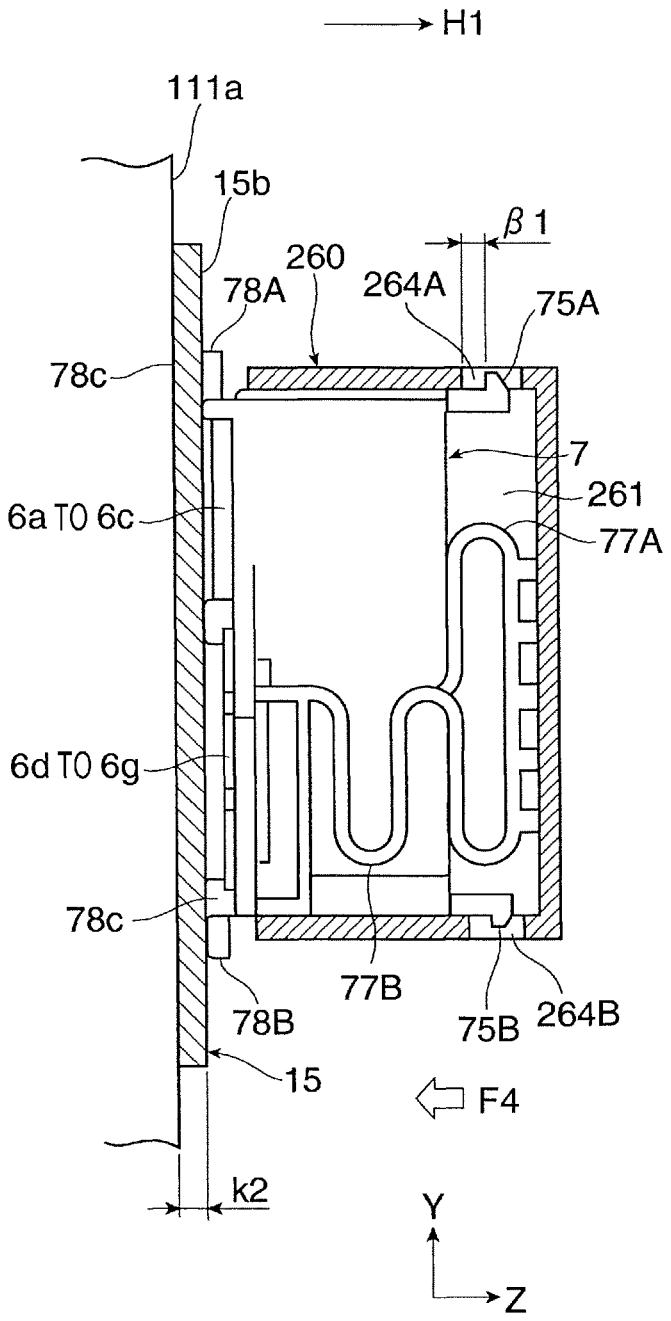
FIG. 14 is an explanatory view of a principal portion showing a state of the second connection terminals and the holding member in relation to the contact section when the mounting of the removable unit shown in FIG. 13 has progressed slightly.

By this, as shown in FIG. 14, the holding member 7 is displaced by a distance β1 from the inner side of the accommodation space 261 of the mounting portion 260 of the removable unit 20. At this time, the second connection terminals 6*a* to 6*g* that are held by the holding member 7 are kept out of contact with the contact surface 15*b* of the contact section 15 because the side surfaces 78*c* of the fitting protrusions 78A and 78B that protrude outward from the side surface 70 of the holding member 7 directly contact the contact surface 15*b* of the contact section 15, and the second connection terminals 6*a* to 6*g* are disposed inwardly of the side surfaces 78*c* of the fitting protrusions 78A and 78B. As a result, wear of and damage to the second connection terminals 6*a* to 6*g* caused by unnecessary contact with the contact surface 15*b* when the removable unit 20 is being mounted will not occur. In response to the mounting of the removable unit 20, at this time, the holding member 7 is easily displaced while a portion of the holding member 7 contacts the contact surface 15*b* of the contact section 15. Here, the distance β1 of displacement of the holding member 7 is substantially equal to a value that is obtained by subtracting the displacement amount k2 of the contact section 15 from the level difference j between the guiding surface portion 70*c* and the first side surface portion 70*b* of the side surface 70.

Finally, when the first protrusions 28A and 28B of the removable unit 20 reach the terminal end portions 143*b* of the first mounting guiding grooves 143, the second protrusions 29A and 29B also reach the terminal end portions 144*b* of the second mounting guiding grooves 144.

By this, as shown in FIGS. 1 and 15, the removable unit 20 is mounted while positioned with respect to the mounting section 12 of the image forming apparatus 1.

By mounting the removable unit 20, the input-side connecting member 223 (see FIG. 2) of the photoconductor drum 22, which is provided inside the first protrusion 28A of the removable unit 20, is fitted and connected to the drive-side connecting member 122 (FIG. 10) of the mounting section 12. The input-side connecting member 256 (see FIG. 2) of the developing roller 251 of the developing device 25, which is disposed below the first protrusion 28A of the removable unit 20, is connected to the drive-side connecting member 125 (see FIG. 10) of the mounting section 12.

By this, the connection of the removable unit 20 with the mounting section 12 related to transmission of rotational driving power is completed.

Figure 16:
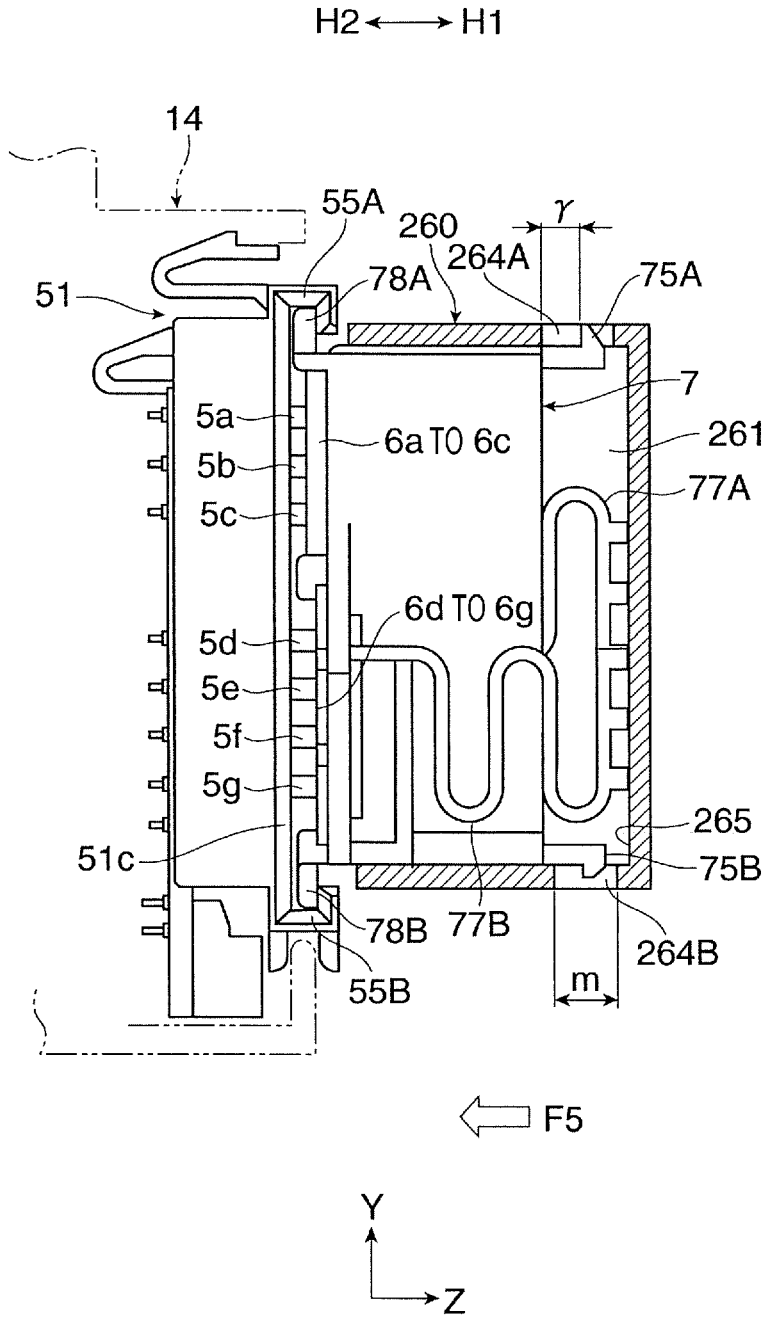
FIG. 16 is a partial sectional explanatory view showing a state in which the removable unit is mounted on the mounting section and the second connection terminals contact and are connected with the first connection terminals.

By mounting the removable unit 20, after the holding member 7 that holds the second connection terminals 6*a* to 6*g* of the removable unit 20 has ended contacting the contact surface 15*b* of the contact section 15 of the guiding supporting member 14 and has passed the contact surface 15*b* of the contact section 15, the following occurs. That is, as shown in FIG. 16, the holding member 7 is guided so as to contact and move onto the guiding surface 51*c* of the holding member 51 of the mounting section 12 that holds the first connection terminals 5*a* to 5*g*, and moves so as to be slightly displaced towards the inner side of the mounting portion 260. Thereafter, the holding member 7 opposes the holding member 51.

By this, the second connection terminals 6*a* to 6*g* of the removable unit 20 are brought into contact with the respective first connection terminals 5*a* to 5*g* that are disposed while fixed to the mounting section 12. As a result, the contact (connection) between the connection terminals 5 of the mounting section 12 and the connection terminals 6 of the removable unit 20 is completed. Here, the first connection terminals 5*a* to 5*g* contact the second connection terminals 6*a* to 6*g* of the removable unit 20 with the first connection terminals 5*a* to 5*g* being elastically deformed so as to fall while being pushed by the side surface portion 71 and an inclined surface portion 71*c* of the holding member 51.

Then, in the removable unit 20 and the mounting section 12, when the removable unit 20 is mounted, the holding member 7 that holds the second connection terminals 6*a* to 6*g* of the removable unit 20 is moved towards the inner side of the accommodation space 261 of the mounting portion 260 (corresponding to the side surface portion 211 of the removable unit 20) and becomes displaced in the direction of arrow H1 by a required distance γ. Moreover, the holding member 7 is subjected to an elastic force (spring force) F5 that is generated by the front elastic deforming portion 77A and the rear elastic deforming portion 77B elastically deformed in accordance with the displacement distance γ, and is put into an elastically pushed state towards the outer side of the accommodation space 261 of the mounting portion 260 in the direction of arrow H2.

The displacement distance γ of the holding member 7 at this time is greater than the displacement distance β1 (FIG. 14) when the removable unit 20 is being mounted. This is because the contact of the holding member 7 with the contact section 15 becomes completed, and because, thereafter, the displacement amount k3 (see FIG. 6) of the holding member 51 that holds the first connection terminals 5*a* to 5*g* of the mounting section 12 that the holding member 7 contacts (through the upper fitting protrusion 78A and the lower fitting protrusion 78B) is greater than the displacement amount k2 (see FIG. 6) of the contact section 15. Consequently, the elastic force (spring force) F5 that the holding member 7 receives from the elastically deformed front elastic deforming portion 77A and rear elastic deforming portion 77B when the mounting of the removable unit 20 is completed becomes greater than the elastic force (spring force) F4 (see FIG. 14) that the holding member 7 receives from the elastically deformed front elastic deforming portion 77A and the rear elastic deforming portion 77B due to the displacement resulting from the contact with the contact section 15 when the removable unit 20 is being mounted (that is, F5>F4).

By this, while the second connection terminals 6*a* to 6*g* that are disposed at the side surface portion 211 of the removable unit 20 through the holding member 7 are kept in a state in which they are subjected to the elastic force (spring force) F5 from the elastically deformed front elastic deforming portion 77A and rear elastic deforming portion 77B, the second connection terminals 6*a* to 6*g* stably contact the first connection terminals 5*a* to 5*g* that are disposed at the mounting section 12 through the holding member 51 without displacing the first connection terminals 5*a* to 5*g* when the removable unit 20 is mounted. The contact state of the second connection terminals 6*a* to 6*g* with respect to the first connection terminals 5*a* to 5*g* is stably maintained even if, for example, the removable unit 20 moves or vibrates slightly after the removable unit 20 has been mounted on the mounting section 12.

In the removable unit 20 and the mounting section 12, when the removable unit 20 is mounted, as shown in FIG. 16, the upper fitting protrusion 78A and the lower fitting protrusion 78B of the holding member 7 that holds the second connection terminals 6*a* to 6*g* are guided to the guiding surface 51*c* of the holding member 51 that holds the first connection terminals 5*a* to 5*g*, and are moved so as to be guided into the upper fitting groove 55A and the lower fitting groove 55B of the holding member 51 and fitted thereto.

By this, the second connection terminals 6*a* to 6*g* that are disposed at the side surface portion 211 of the removable unit 20 through the holding member 7 contact more stably at precise locations the first connection terminals 5*a* to 5*g* that are disposed at the mounting section 12 through the holding member 51.

The removable unit 20 is removed from the mounting section 12 by moving the removable unit 20 so as to pull out the removable unit 20 in the movement direction D2 of the removable unit 20 when the removable unit 20 is removed.

Incidentally, when the removable unit 20 is to be removed, first, the upper fitting protrusion 78A and the lower fitting protrusion 78B of the holding member 7 that holds the second connection terminals 6*a* to 6*g* of the removable unit 20 are pulled out from the upper fitting groove 55A and the lower fitting groove 55B of the holding member 51 that hold the first connection terminals 5*a* to 5*g* of the mounting section 12. At this time, the second connection terminals 6*a* to 6*g* move away from the first connection terminals 5*a* to 5*g*, and are brought out of contact with the first connection terminals 5*a* to 5*g*. Thereafter, the holding member 7 moves while the side surface portion 78*c* of the upper fitting protrusion 78A and the side surface portion 78*c* of the lower fitting protrusion 78B are brought into a state of contact again with the contact surface 15*b* of the contact section 15 of the mounting section 12. Next, when the removable unit 20 is further pulled, the holding member 7 is brought out of contact with the contact surface 15*b* of the contact section 15. At this stage, the holding member 7 becomes displaced in the direction of arrow H2 towards the outer side of the side surface portion 211 (mounting portion 260) of the removable unit 20 (see FIGS. 2 and 7).

Other Exemplary Embodiments

Although, in the above-described exemplary embodiment, the structure including the upper fitting protrusion 78A and the lower fitting protrusion 78B is exemplified as the holding member 7 for the removable unit 20, it is possible to apply a structure that does not include the upper fitting protrusion 78A and the lower fitting protrusion 78B to the holding member 7. In this case, the upper fitting groove 55A and the lower fitting groove 55B of the holding member 51 at the mounting section 12 are also not provided. As the elastic members that elastically push the holding member 7, instead of the elastic deforming portions 77A and 77B exemplified in the above-described exemplary embodiment, other elastic members, such as leaf springs, coil springs, and soft rubber, which are provided separately from the holding member 7 may also be used.

Although, in the above-described exemplary embodiment, the structure in which the side surface portion of the holding member 7 at the removable unit 20 is provided with the guiding surface portion 70*c* is exemplified, other structures may be used. Such other structures include a structure in which a guiding surface portion has a shape that, when the removable unit 20 is mounted, allows it to contact part of the contact section 15 of the mounting section 12 and to gradually guide the holding member 7 to the inner side of the side surface portion 211 of the removable unit 20 (in the direction of arrow H1).

Further, as long as the removable unit 20 is one in which the second connection terminals 6 are disposed at the side surface portion 211, removable units having other structures may be used as the removable unit 20. For example, the number, the type, the shape, and the arrangement of the first connection terminals 5 that are disposed at the mounting section 12 and the second connection terminals 6 that are disposed at the removable unit 20 may be changed within a range in which the first connection terminals 5 and the second connection terminals 6 are capable of stably contacting each other when the removable unit 20 is mounted on the mounting section 12.

Further, as long as the image forming apparatus 1 to which the invention is applied includes the mounting section at which the first connection terminals are disposed and the removable unit that is removably mounted on the mounting section and at which the second connection terminals that are connected to the first connection terminals are disposed, the structure of an image forming system or the like is not particularly limited to certain structures. For example, although, in the above-described exemplary embodiment, the image forming apparatus 1 is one that forms a monochromatic image by using one removable unit 20, the image forming apparatus may be one that forms images of multiple colors by using multiple removable units 20 that form images of different colors. If necessary, the image forming apparatus may be one that forms images formed from materials other than developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body that includes a mounting section that is provided with a first connection terminal that performs electrical connection; and a removable unit that is removably mounted on the mounting section of the apparatus body, the removable unit being provided with a second connection terminal that is disposed at a side surface portion of the removable unit and that contacts and is connected with the first connection terminal when the removable unit is mounted, the side surface portion being a side surface with respect to a movement direction of the removable unit when the removable unit is mounted or removed, wherein the second connection terminal is held by a holding member that is mounted on the side surface portion of the removable unit while the holding member is displaceable in a direction that is orthogonal to the movement direction of the removable unit when the removable unit is mounted or removed and while the holding member is pushed towards an outer side of the side surface portion by an elastic member, when the removable unit is mounted, the holding member becomes displaced towards an inner side of the side surface portion, and becomes pushed towards the outer side of the side surface portion by the elastic member that is elastically deformed in accordance with the displacement towards the inner side, so that the second connection terminal contacts the first connection terminal, and the side surface portion includes a mounting portion having a guiding hole formed in at least one of first and second surfaces of the mounting portion which face each other, and the holding member is provided with a fitting protrusion that is fitted into the guiding hole when the removable unit is mounted.

2. The image forming apparatus according to claim 1, wherein the mounting section of the apparatus body is provided with a contact section that contacts the holding member and keeps the holding member displaced towards the inner side of the side surface portion when the removable unit is mounted or removed.

3. The image forming apparatus according to claim 2, wherein a guiding surface portion is provided, the guiding surface portion having a shape that, when the removable unit is mounted, allows the guiding surface portion to contact the contact section and to gradually guide the displacement of the holding member towards the inner side of the side surface portion.

4. The image forming apparatus according to claim 1, wherein after the fitting protrusion is fitted into the guiding hole when the removable unit is mounted, the fitting protrusion is displaceable in the direction that is orthogonal to the movement direction of the removable unit when the removable unit is mounted or removed.

5. A removable unit that is removably mounted on a mounting section where a first connection terminal that performs electrical connection is disposed in an apparatus body of an image forming apparatus, the removable unit comprising:

a second connection terminal that is disposed at a side surface portion of the removable unit and that contacts and is connected with the first connection terminal when the removable unit is mounted, the side surface portion being a side surface with respect to a movement direction of the removable unit when the removable unit is mounted or removed, wherein the second connection terminal is held by a holding member that is mounted on the side surface portion while the holding member is displaceable in a direction that is orthogonal to the movement direction of the removable unit when the removable unit is mounted or removed and while the holding member is pushed towards an outer side of the side surface portion by an elastic member, when the removable unit is mounted, the holding member becomes displaced towards an inner side of the side surface portion, and becomes pushed towards the outer side of the side surface portion by the elastic member that is elastically deformed in accordance with the displacement towards the inner side, so that the second connection terminal contacts the first connection terminal, and the side surface portion includes a mounting portion having a guiding hole formed in at least one of first and second surfaces of the mounting portion which face each other, and the holding member is provided with a fitting protrusion that is fitted into the guiding hole when the removable unit is mounted.

6. The removable unit according to claim 5, wherein after the fitting protrusion is fitted into the guiding hole when the removable unit is mounted, the fitting protrusion is displaceable in the direction that is orthogonal to the movement direction of the removable unit when the removable unit is mounted or removed.

* * * * *